US005428428A

United States Patent [19]

Haneda

[11] Patent Number: 5,428,428

[45] Date of Patent: Jun. 27, 1995

[54] DEVELOPING DEVICE HAVING A CONTROL ELECTRODE

[75] Inventor: Satoshi Haneda, Hachioji, Japan

[73] Assignee: Konica Corporation, Tokyo, Japan

[21] Appl. No.: 67,547

[22] Filed: May 26, 1993

[30] Foreign Application Priority Data

Jun. 15, 1992 [JP] Japan ..... 4-155126
Jul. 1, 1992 [JP] Japan ..... 4-174352
Oct. 8, 1992 [JP] Japan ..... 4-270424

[51] Int. Cl.[6] ..... G03G 15/09

[52] U.S. Cl. ..... 355/246; 118/653; 355/261

[58] Field of Search ..... 355/246, 245, 251, 253, 355/259, 261, 263, 265; 118/651, 657, 658, 656, 653

[56] References Cited

U.S. PATENT DOCUMENTS 4,089,297 5/1978 Morita et al. ..... 118/647
4,287,850 9/1981 Yamamoto et al. ..... 18/657
4,444,864 4/1984 Takahashi ..... 430/120
4,662,311 5/1987 Shoji et al. ..... 118/651
4,697,914 10/1987 Hauser ..... 355/215
4,777,107 10/1988 Kurematsu et al. ..... 130/122
4,804,994 2/1989 Sasaki et al. ..... 118/657 X
4,844,008 7/1989 Sakemi et al. ..... 118/658
4,962,723 10/1990 Hotomi .
5,010,367 4/1991 Hays .
5,031,570 7/1991 Hays et al. .
5,172,170 12/1992 Hays et al. ..... 355/259
5,175,070 12/1992 Tanikawa et al. .
5,202,731 4/1993 Tanikawa et al. .
5,253,016 10/1993 Bebe et al. ..... 355/215
5,255,057 10/1993 Stelter et al. ..... 355/246
5,268,259 12/1993 Sypula ..... 430/311
5,270,782 12/1993 Floyd, Jr. ..... 355/245
5,298,949 3/1994 Yamamoto et al. ..... 355/296

FOREIGN PATENT DOCUMENTS

0420197A2 4/1991 European Pat. Off. .
0424180A3 4/1991 European Pat. Off. .
0432998A3 6/1991 European Pat. Off. .

OTHER PUBLICATIONS

Patent Abstracts of Japan, vol. 15, No. 347 (P-1246), Sep. 3, 1991 & JP-A-03 131 879 (Canon), Jun. 5, 1991.

*Primary Examiner*—A. T. Grimley
*Assistant Examiner*—Thu A. Dang
*Attorney, Agent, or Firm*—Frishauf, Holtz, Goodman & Woodward

[57] ABSTRACT

Apparatus for developing an electrostatic latent image formed on a photoreceptor with developer, includes a developing sleeve, a plate disposed between a photoreceptor and the sleeve, an electrode member fixed to the plate member, and a bias member for forming a first oscillating electric field between the electrode member and the sleeve and a second oscillating electric field between the photoreceptor and the sleeve.

20 Claims, 11 Drawing Sheets

DEVELOPING DEVICE HAVING A CONTROL ELECTRODE

BACKGROUND OF THE INVENTION

The present invention relates to a developing device to develop an electrostatic or a magnetic latent image with two-component developer in which magnetic carrier particles and toner particles are mixed in an electrophotographic copier, and alternatively the present invention relates to a developing device to develop an electrostatic or a magnetic latent image with one-component developer composed of non-magnetic toner in an electrophotographic copier.

Conventionally, a magnetic brush type developing device using two-component developer is frequently applied to an electrophotographic copier. This developing device includes a magnetic roller composed of a magnet having a plurality of magnetic poles, and a cylindrical developing sleeve which is rotatably supported. Magnetic carrier particles to which toner particles are deposited are held on the surface of this developing sleeve so that the magnetic carrier particles are conveyed to a developing region for development. In this developing device, triboelectric charging can be relatively easily controlled, so that the toner particles are less susceptible to coagulation, and excellent bristles can be provided in the magnetic brush. The surface of an image carrier has desirable frictional properties, and cleaning can be sufficiently conducted on the surface of the image carrier. Moreover, this developing device is also suitable for non-contact development in which a developing operation is conducted under the condition that the image carrier surface is not contacted. For the reasons described above, this developing device is frequently used although the amount of toner particles must be controlled with respect to the amount of carrier particles. However, for the contact developing system in which the image carrier surface is rubbed by the magnetic brush, a developer composed of magnetic carrier particles of which the diameter is several tens to several hundreds μm and non-magnetic toner particles of which the average diameter is about 10 μm, is conventionally used. Therefore, the toner and carrier particles are so coarse that fine lines and small spots can not be reproduced, and delicate contrast can not be reproduced either. Accordingly, it is difficult to provide an image of high quality. This developing device has the problems described above. In order to solve the problems, a large number of countermeasures have been taken, for example, the carrier particles are coated with resin, and the magnet used for the developer carrier is improved. Although many efforts have been made, images of sufficient quality have not been provided yet. Therefore, it is necessary to reduce the sizes of toner and carrier particles, in other words, it is necessary to make the toner and carrier particles more minute. However, when the average particle size of toner is not more than 20 μm, and especially when the average particle size of toner is not more than 10 μm, the following problems are caused.

(1) In the developing process, Van der Waals force relatively affects Coulomb's force. Therefore, toner particles deposit on the background, and fogging is caused. Therefore, even when a DC bias voltage is impressed upon the developer carrier, it is difficult to prevent the occurrence of fogging.

(2) It becomes difficult to control triboelectric charging of toner particles, so that the toner particles are susceptible to coagulation.

(3) On the other hand, when the dimensions of carrier particles are reduced, the carrier particles are deposited on the electrostatic portion on the image carrier. The reason is considered to be that the force of the magnetic bias is lowered and the carrier particles are deposited on the image carrier together with the toner particles. In this connection, when the bias voltage is increased, the carrier particles are deposited on the background of the image. When the particle size is reduced, the above effect becomes remarkable, so that clear images can not be provided. Therefore, it is not practical to reduce the size of toner and carrier particles.

A developing device using one-component developer composed of non-magnetic toner includes a cylindrical developing sleeve which is rotatably supported, the surface of which is rough, and toner is held on the surface of this developing sleeve so that the toner is conveyed to the developing region for development. This developing device is also used for non-contact development in which development is performed under the condition that the image carrier surface is not contacted. However, in this developing device, a developer composed of non-magnetic toner particles, of which the average particle size is about 10 μm, has been conventionally used. As the toner particles are relatively large, it is difficult to provide images of high quality on which fine lines and delicate contrast are excellently reproduced. In order to solve the above problems, it can be considered to reduce the size of the one-component developer, however, the aforementioned problems (1) and (2) are caused in the same manner as with the toner in two-component developer.

In order to solve the problems, the following methods have been proposed:

One method has been disclosed in Japanese Patent Publication Open to Public Inspection No. 223467/1984, applied by the inventors of the present invention, in which a control electrode to control airborne toner particles is provided in the development region, and development is performed in an oscillating electric field generated when a bias voltage having an AC voltage component is impressed.

Another method has been disclosed in Japanese Patent Publication Open to Public Inspection Nos. 131878/1991, 131879/1991 and 115264/1992, in which a plate-shaped member is disposed upstream of the developing region, and an AC bias voltage is impressed upon the plate-shaped member so that a toner cloud can be generated.

Still another method has been disclosed in Japanese Patent Publication Open to Public Inspection No. 94368/1989 in which a smoothing member is provided between the center of a development region and a restricting member to restrict the thickness of a developer layer, and a DC bias voltage is impressed upon this smoothing member, the polarity of which is reverse to the charging polarity of toner particles.

However, in the former method, when the control electrodes are used, they are stained and their electric field is oscillated. Moreover, it is difficult to maintain the control electrodes in alignment. Therefore, uneven density is caused, so that images of a predetermined level of quality can not be provided.

Even when the plate-shaped member is provided, the following problems are caused: the phase of the AC bias voltage of the control electrode is not the same between the image forming body and the developing sleeve; toner staining tends to occur since an AC electric field is generated in the upstream portion of the plate-shaped member; and further sufficient function is not provided so as to introduce the generated toner cloud into the developing region.

In the latter method, the bias voltage is impressed upon the smoothing member, the polarity of which is reverse to the charging polarity of toner particles, so that toner is deposited on the smoothing member. When the toner is adhered onto a photoreceptor surface, images are stained. Moreover, the oscillating conditions of the developer are changed, so that development is affected.

SUMMARY OF THE INVENTION

It is an object of the present invention to solve the above problems and to provide a developing device of high developing efficiency that can provide even images.

In the case of a color image forming apparatus in which toner images are superimposed on an image carrier so as to obtain a multicolor image and the formed multicolor image is transferred onto a transfer sheet in one operation, the present invention can solve the problem of the occurrence of color mixture between toner images caused by an oscillating electric field.

In order to accomplish the above objects, the present invention is to provide a developing device in which developer is conveyed onto a developing sleeve and toner is flown in an oscillating electric field for development, wherein the developing device is characterized in that: a plate member having an electrode in the upstream portion of the development region is positioned with a gap from the developing sleeve; a first oscillating electric field is formed between the electrode and the developing sleeve; and a second oscillating electric field is formed between the photoreceptor and the developing sleeve, wherein the intensity of the first oscillating electric field is set to be stronger than that of the second oscillating electric field, and an electric field is formed between the photoreceptor and the electrode so as to move the toner to the photoreceptor.

A preferable embodiment of the developing device of the invention is composed in the following manner: the oscillating electric field is formed among the developing sleeve, the photoreceptor and the electrode; and an oriented electric field is formed between the photoreceptor and the electrode.

DETAILED DESCRIPTION OF THE PREFERRED EMBODIMENT

Figure 4:
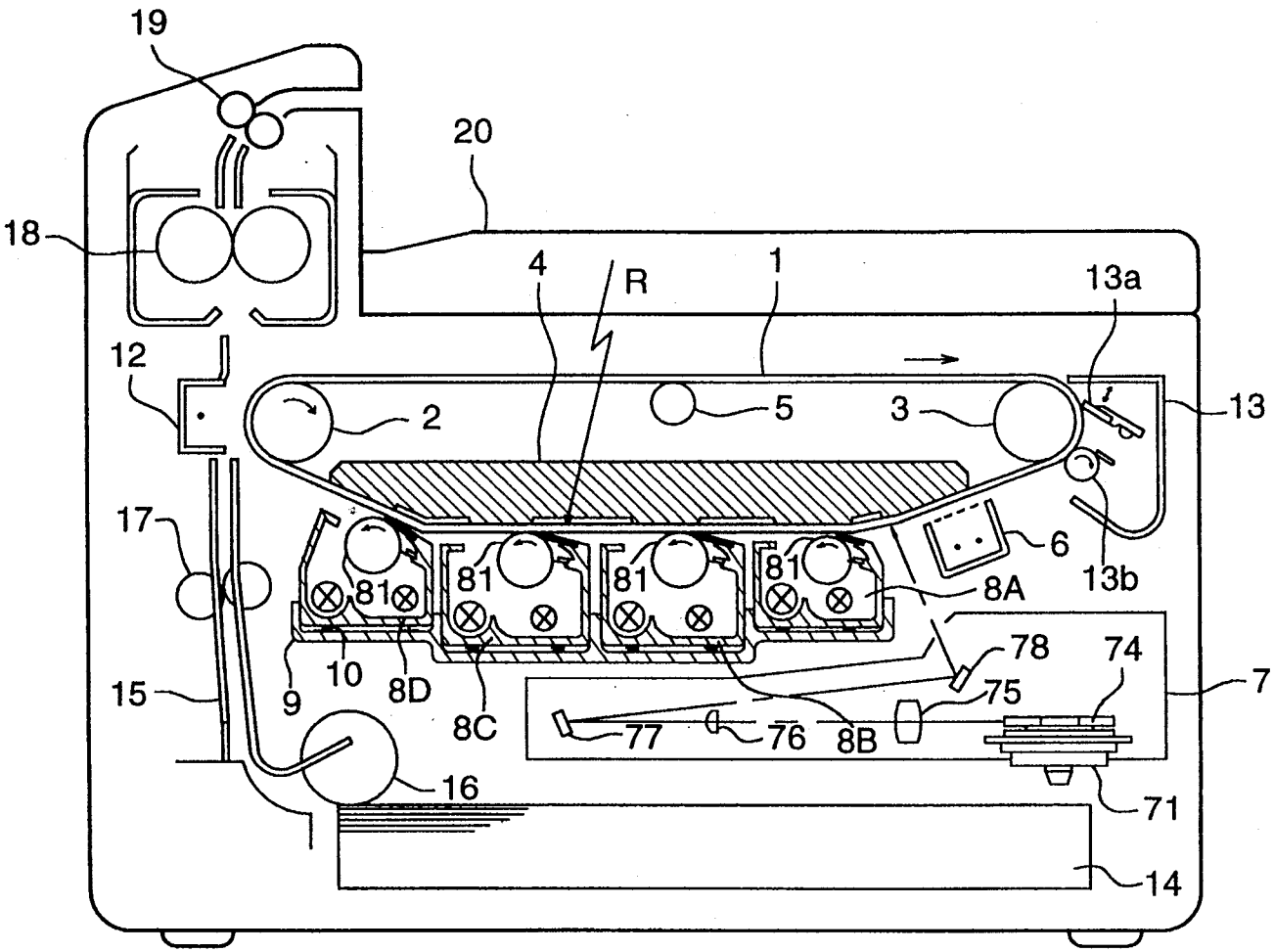
FIG. 4 is a sectional view showing an example of a color image forming apparatus having the developing device of the present invention.

FIG. 4 is a sectional view showing the structure of an example of a color image forming apparatus to which the developing device of the invention is applied.

In FIG. 4, numeral 1 is a photoreceptor belt which is a flexible belt-shaped image forming body on which a photoconductor is coated or vapor-deposited. This photoreceptor belt 1 is provided between rotating rollers 2 and 3, and when the rotating roller 2 is driven, the photoreceptor belt 1 is conveyed clockwise.

Numeral 4 is a guide member which is fixed to the apparatus body for guiding the photoreceptor belt 1. When tension is given to the photoreceptor belt 1 by the action of a tension roller 5, the internal surface of the photoreceptor belt is slidably contacted with the guide member 4.

Numeral 6 is a scorotron type of charging unit. Numeral 7 is an image exposure section, that is, numeral 7 is an optical writing unit which conducts a writing operation (an exposing operation) with laser beams. Numerals 8A to 8D are a plurality of developing devices of the present invention in which developers of specific colors are accommodated. These are disposed in the position where the guide member 4 comes into contact with the photoreceptor belt 1.

The developing devices 8A, 8B, 8C and 8D will be described in detail later. For example, the developing units respectively accommodate developers of yellow, magenta, cyan and black. Each developing device is provided with a developing sleeve 81, and a predetermined gap is formed between the developing sleeve 81 and the photoreceptor belt 1. Therefore, an electrostatic latent image on the photoreceptor belt 1 is visualized by the method of non-contact reversal development. Unlike the contact development method, this non-contact development method is advantageous in that: the photoreceptor belt 1 can be moved while it holds a toner image on its surface.

Numeral 12 is a transfer unit. Numeral 13 is a cleaning unit. While an image is being formed, a blade 13*a* of the cleaning unit 13 and a toner conveyance roller 13*b* are separated from the surface of the photoreceptor belt 1, and only in a cleaning operation conducted after the image has been formed are the blade 13*a* and the toner conveyance roller 13*b* contacted with the surface of the photoreceptor belt 1 with pressure.

The color image forming process of this color image forming apparatus will be described as follows.

Figure 5:
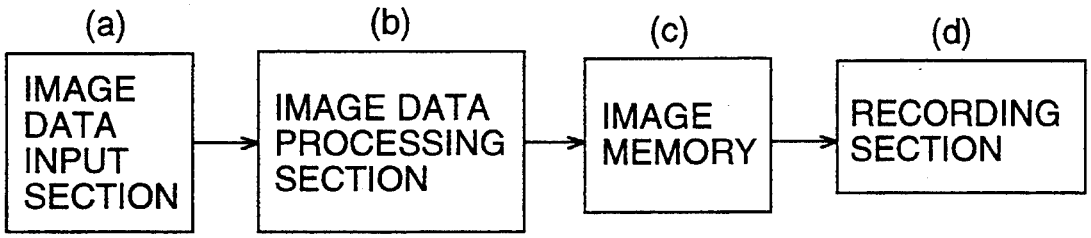
FIG. 5 is a block diagram showing an image formation system.

In this example, multicolor image formation is carried out in accordance with the image formation system shown in FIG. 5. Color image data is obtained by the color image data input section (a) in which an original image is scanned by an image sensor. Then the obtained data is subjected to calculation processing in the image data processing section (b) so that image data is made. After that, the image data is temporarily stored in the image memory (c). Then the image data is taken out from the memory, in the case of recording, and inputted into the color image forming apparatus shown in FIG. 4 that is the recording section (d). When image data of each color outputted from an image reading unit provided separately from the aforementioned color image forming apparatus is inputted into optical writing unit 7, laser beams (image writing light), generated by a laser diode not shown, pass through a collimator lens and a cylindrical lens (not shown) and are subjected to rotary scanning by a rotary polygonal mirror 74; then laser beams L pass through an $f\theta$ lens 75 and a cylindrical lens 73 while the optical path of laser beams is deflected by mirrors 76 and 77; and laser beams are projected on the circumferential surface of the photoreceptor belt 1 on which a uniform electrical charge is previously given by the scorotron charger 6, so that primary scanning is carried out and a bright line is formed.

When the scanning operation starts, the laser beam is detected by an index sensor not shown in the drawing. Laser beams modulated according to the first color signal, scan the circumferential surface of the photoreceptor belt 1. Consequently, a latent image corresponding to the first color is formed on the circumferential surface of the photoreceptor belt 1 by the action of primary scanning conducted by laser beams and auxiliary scanning conducted by the conveyance of the photoreceptor belt 1. This latent image is reversal-developed by a developing unit 8A loaded with yellow (Y) toner, so that a toner image is formed on the circumferential surface of the photoreceptor belt 1. While the obtained toner image is maintained on the surface of the photoreceptor belt 1, it passes below the blade 13*a* of the cleaning unit 13 which has been separated from the surface of the photoreceptor belt 1. Then, the process advances to the next image forming cycle.

That is, the photoreceptor belt 1 is charged again by the charging unit 6, and image data of the second color outputted from the image data processing section is inputted into the optical writing unit 7, and then the image data of the second color is written onto the circumferential surface of the photoreceptor belt 1 in the same manner as the first color so that a latent image is formed. The latent image is developed by the developing device 8B loaded with magenta (M) toner.

The magenta (M) toner image is formed on the yellow (Y) toner image.

Numeral 8C is a developing device provided with cyan (C) toner, and a cyan (C) toner image is formed on the belt surface in the same manner as that of the first and second colors.

Numeral 8D is a developing unit provided with black toner, and a black toner image is formed and superimposed on the belt surface in the same manner. DC bias and/or AC bias is impressed upon each sleeve of the developing devices 8A, 8B, 8C and 8D, and non-contact developing is conducted by two-component developer which is an image visualizing means, so that the toner image on the photoreceptor belt 1, the base of which is grounded, is developed.

High voltage, the polarity of which is reverse to that of toner, is impressed upon the color toner image formed on the circumferential surface of the photoreceptor belt 1, and the toner image is transferred in the transfer section onto a transfer sheet which has been sent from a paper feed cassette 14 through a paper feed guide 15.

That is, the uppermost transfer sheet in the paper feed cassette 14 is conveyed out from the paper feed cassette 14 by the rotation of the paper feed roller 16, and supplied to the transfer unit 12 through a timing roller 17 in synchronization with the image formation conducted on the photoreceptor belt 1.

The transfer sheet onto which an image is transferred, is positively separated from the photoreceptor belt 1, the conveyance direction of which is sharply changed when it is rotated around the rotating roller 2. Then, the transfer sheet is conveyed upward. After that, the image on the photoreceptor belt 1 is fixed by a fixing roller 18, and discharged onto a tray 20 by a discharge roller 19.

After the image has been transferred onto the transfer sheet, the photoreceptor belt 1 is further rotated, and residual toner on the belt is removed by the cleaning unit 13, the blade 13*a* and the toner conveyance roller 13*b* of which are contacted with the surface of the belt with pressure. After the cleaning operation has been completed, the blade 13*a* is separated again from the belt surface, and a little after that, the toner conveyance roller 13*b* is separated, and a new image forming process is started.

The developing device of the invention described above is applied to a color image forming apparatus having a belt-shaped image carrier. Also, the developing device of the invention described above can be applied to a color image forming apparatus having a drum-shaped image carrier.

Figure 1A:
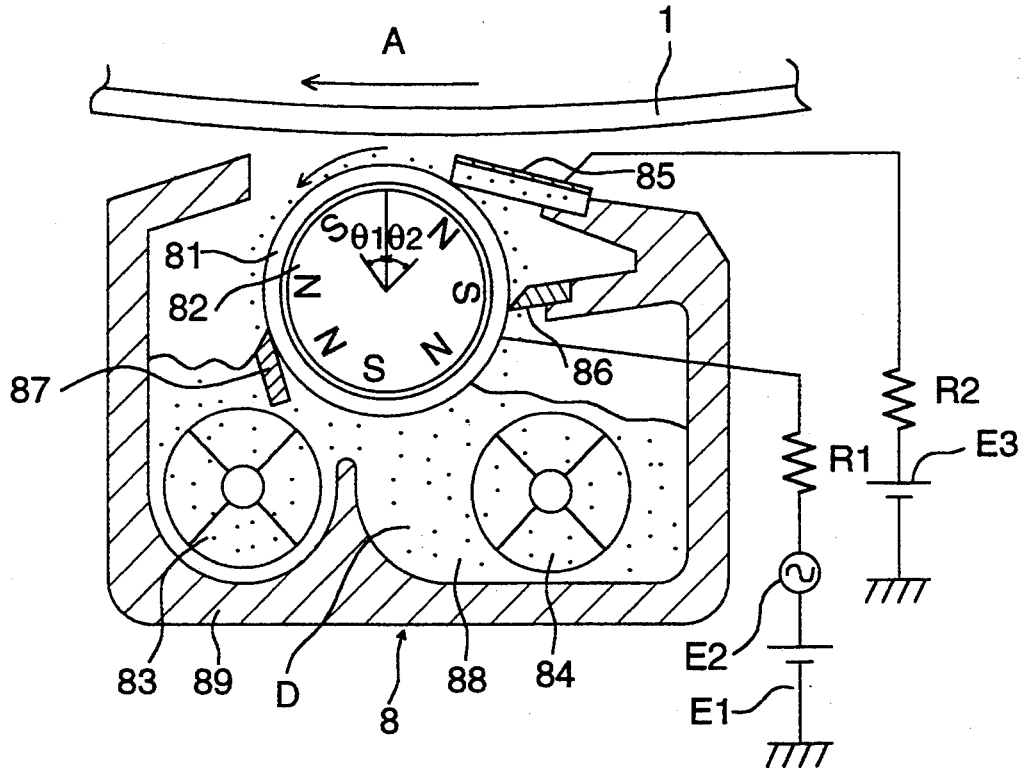
FIGS. 1*a* and 1*b* are sectional views showing example 1 of the developing device of the present invention applied to two-component developer.
Figure 2A:
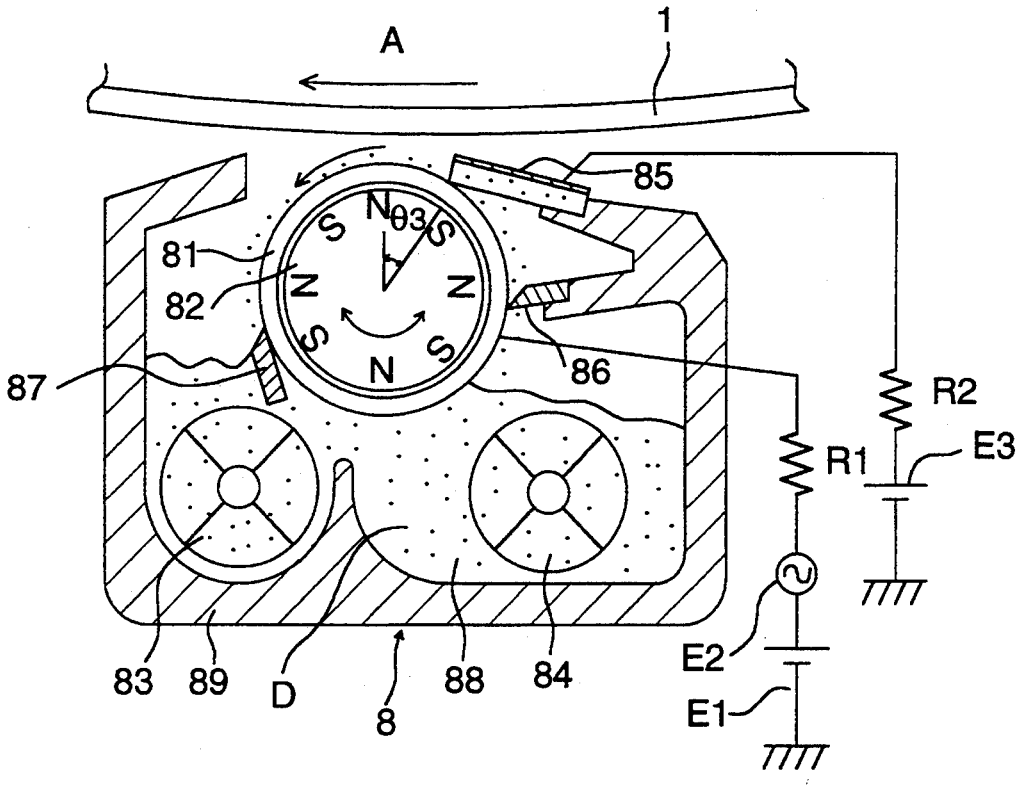
FIGS. 2*a* and 2*b* are sectional views showing example 2 of the developing device of the present invention.
Figure 2B:
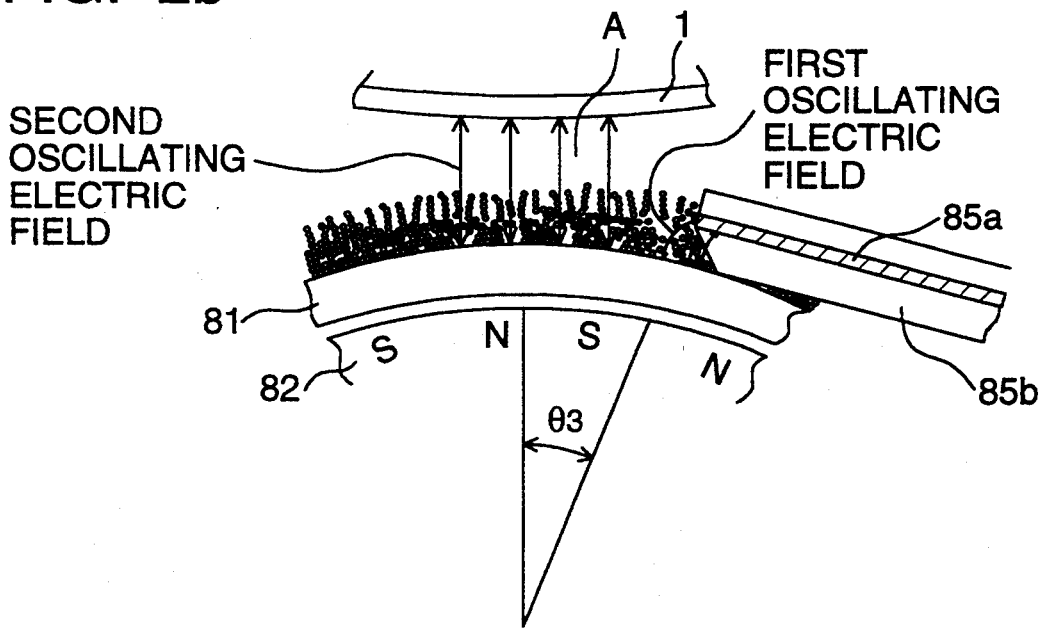
Figure 3A:
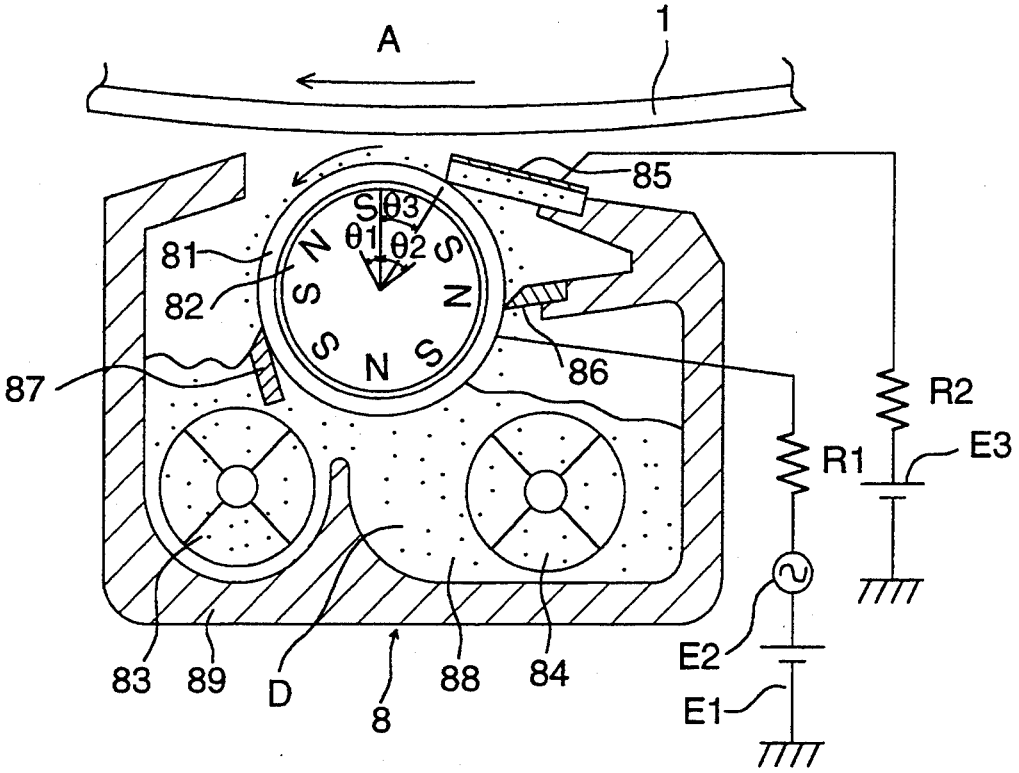
FIGS. 3*a* and 3*b* are sectional views showing example 3 of the developing device of the present invention.
Figure 3B:
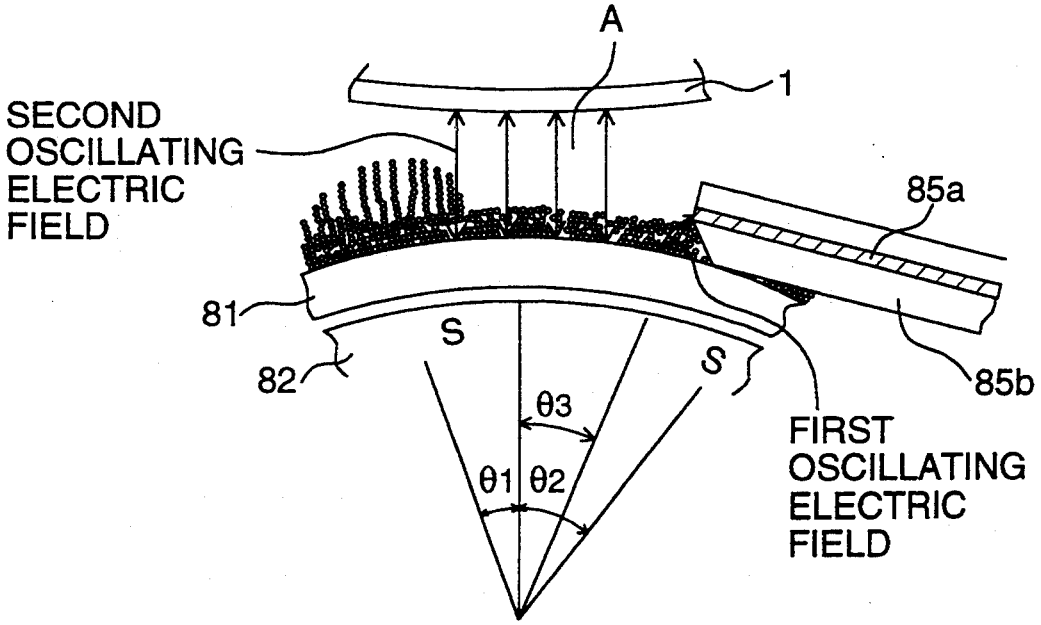

The developing devices 8A to 8D are constituted with the same structure. Therefore, they will be represented by reference numeral 8 hereinafter. FIGS. 1 to 3 are sectional views schematic of the developing devices of the present invention. FIG. 1(*a*) is a sectional view of example 1 of the device of the present invention. In the drawing, numeral 81 is a developing sleeve made of non-magnetic material such as aluminum, and numeral 82 is a magnetic body provided inside the developing sleeve 81, wherein a plurality of N and S magnetic poles are circumferentially provided on the surface. The developing sleeve 81 and the magnetic body 82 compose a developer carrier. The developing sleeve 81 can be rotated with respect to the magnetic body 82. In the drawings the developing sleeve 81 is rotated counterclockwise in the direction of an arrow. The N and S magnetic poles of the magnetic body 82 are usually magnetized so that the magnetic flux density can be 500 to 1500 gauss. By the magnetic force of the magnetic poles, a layer of developer D composed of toner and carrier particles, that is, a magnetic brush is formed on the surface of the developing sleeve 81. When the developing sleeve 81 is rotated, this magnetic brush is rotated in the same direction as that of the rotational direction of the developing sleeve 81, so that the toner and carrier particles are conveyed to developing region A. A gap between the developing sleeve 81 and the regulation blade 86, and also a gap between the developing sleeve 81 and the photoreceptor belt 1 are adjusted so that the magnetic brush formed on the developing sleeve 81 can not be contacted with the surface of the photoreceptor belt 1, the formed magnetic brush bristles being laid down on the surface of the developing sleeve 81 by the action of the N and S magnetic poles disposed close to the developing device.

In this case, $\theta_1$ is an angle formed by two positions, one being the position at which the distance between the developing sleeve and the photoreceptor is the smallest and the other being a position at which a magnetic pole is disposed downstream of the rotation of the developing sleeve. $\theta_2$ is an angle formed by two positions, one being the position at which the distance between the developing sleeve and the photoreceptor is the smallest and the other being a position at which a magnetic pole is disposed upstream of the rotation of the developing sleeve.

In this case, it is preferable that angles $\theta_1$ and $\theta_2$ are respectively determined to be 5° to 45°. As a result of the foregoing, a magnetic brush in which bristles are uniformly formed can be provided.

Numerals 83 and 84 are stirring screws that stir and circulate developer D in the direction perpendicular to the surface of the drawing so that the composition of developer D can be made uniform. Numeral 85 is a plate-shaped electrode disposed upstream of developing region A for the purpose of forming an oscillating electric field. The plate-shaped electrode 85 is constituted in the following manner: a plate-shaped electrode 85*a* made of conductive material such as a metal is integrally provided on an insulating member 85*b* made of insulating material such as rubber that comes into contact with the developing sleeve 81.

The plate-shaped electrode 85 is mounted on a magnetic pole provided on the upstream side and directed downward. The setting angle $\theta_3$ of the plate-shaped electrode 85 is preferably from 0.2 to 0.9 of $\theta_2$.

Numeral 86 is a regulating blade, that is, a developer regulating means made of non-magnetic or magnetic material so as to regulate the height and amount of the magnetic brush. Numeral 87 is a cleaning blade to remove a magnetic brush that has passed through developing region A from the developing sleeve 81. Numeral 88 is a developer reservoir. Numeral 89 is a casing. A bias voltage in which DC and AC voltages are superimposed is impressed upon the developing sleeve 81 through protective resistor R1 by DC bias power source E1 and AC bias power source E2. A bias voltage is impressed upon the electrode 85*a* of the plate-shaped electrode 85 through protective resistor R2 by DC bias power source E3.

In example 1 shown in FIG. 1, the magnetic flux density of the N pole of the magnetic body 82 and that of the S pole are approximately the same, and the magnetic body 82 is fixed. Unlike the device shown in FIG. 1, in the device shown in FIG. 2, the magnetic body 82 is rotated in the same direction as that of the developing sleeve or in the reverse direction. Unlike the device shown in FIG. 1, in the device shown in FIG. 3, the fixed magnetic body disposed close to the developing section is composed of S poles.

FIG. 2(*a*) is a sectional view of example 2 of the device of the present invention. In the drawing, numeral 81 is a developing sleeve made of non-magnetic material such as aluminum, and numeral 82 is a magnetic body rotatably provided inside the developing sleeve 81, wherein a plurality of N and S magnetic poles are circumferentially provided at regular intervals on the surface. The developing sleeve 81 and the magnetic body 82 compose a developer carrier. The developing sleeve 81 can be rotated. In the drawing the developing sleeve 81 is rotated counterclockwise in the direction of an arrow, and the magnetic body 82 is rotated clockwise. The N and S magnetic poles of the magnetic body 82 usually have the magnetic flux density of 500 to 1500 gauss. By the magnetic force of the magnetic poles, a layer of developer D composed of toner and carrier particles, that is, a magnetic brush is formed on the surface of the developing sleeve 81. When the developing sleeve 81 and the magnetic body 82 are rotated, this magnetic brush is rotated in the same direction as that of the rotational direction of the developing sleeve 81, so that the toner and carrier particles are conveyed to developing region A. A gap between the developing sleeve 81 and the regulation blade 86, and also a gap between the developing sleeve 81 and the photoreceptor belt 1 are adjusted so that the magnetic brush formed on the developing sleeve 81 can not be contacted with the surface of the photoreceptor belt 1.

Numerals 83 and 84 are stirring screws that stir and circulate developer D in the direction perpendicular to the surface of the drawing so that the composition of developer D can be made uniform. Numeral 85 is a plate-shaped electrode disposed upstream of developing region A for the purpose of forming an oscillating electric field. The plate-shaped electrode 85 is constituted in the following manner: a plate-shaped electrode 85*a* made of conductive material such as a metal is integrally provided on an insulating member 85*b* made of insulating material such as rubber that comes into contact with the developing sleeve 81. Numeral 86 is a regulating blade, that is, a developer regulating means made of non-magnetic or magnetic material so as to regulate the height and amount of the magnetic brush. Numeral 87 is a cleaning blade to remove a magnetic brush that has passed through developing region A from the developing sleeve 81. Numeral 88 is a developer reservoir. Numeral 89 is a casing. A bias voltage in which DC and AC voltages are superimposed is impressed upon the developing sleeve 81 through protective resistor R1 by DC bias power source E1 and AC bias power source E2. A bias voltage is impressed upon the electrode 85*a* of the plate-shaped electrode 85 through protective resistor R2 by DC bias power source E3.

In the third example shown in FIG. 3, the developing sleeve 81 can be rotated with respect to the magnetic body 82. In the drawing, it is shown that the developing sleeve 81 is rotated counterclockwise in the direction of an arrow. The S and S magnetic poles of the magnetic body 82 are usually magnetized so that the magnetic flux density can be 500 to 1500 gauss. By the magnetic force of the magnetic poles, a layer of developer D composed of toner and carrier particles, that is, a magnetic brush is formed on the surface of the developing sleeve 81. When the developing sleeve 81 is rotated, this magnetic brush is rotated in the same direction as that of the rotational direction of the developing sleeve 81, so that the toner and carrier particles are conveyed to developing region A. A gap between the developing sleeve 81 and the regulation blade 86, and also a gap between the developing sleeve 81 and the photoreceptor belt 1 are adjusted so that the magnetic brush formed on the developing sleeve 81 becomes airborne by the action of a repulsive magnetic field of S and S magnetic poles disposed close to the developing region, and so that the magnetic brush does not rub the surface of the photoreceptor belt 1 but can travel in an airborne cloud.

In this case, it is preferable that angles $\theta_1$ and $\theta_2$ are respectively determined to be 5° to 45°. As a result of the foregoing, a magnetic brush in which bristles are uniformly formed can be provided.

Numerals 83 and 84 are stirring screws that stir and circulate developer D in the direction perpendicular to the surface of the drawing so that the composition of developer D can be made uniform. Numeral 85 is a plate-shaped electrode disposed upstream of developing region A for the purpose of forming an oscillating electric field. The plate-shaped electrode 85 is constituted in the following manner: a plate-shaped electrode 85*a* made of conductive material such as a metal is integrally provided on an insulating member 85*b* made of insulating material such as rubber that comes into contact with the developing sleeve 81.

The plate-shaped electrode 85 is mounted on a magnetic pole provided on the upstream side and directed downward. The setting angle $\theta_3$ of the plate-shaped electrode 85 is preferably from 0.2 to 0.9 of $\theta_2$.

Numeral 86 is a regulating blade, that is, a developer regulating means made of non-magnetic or magnetic material so as to regulate the height and amount of the magnetic brush. Numeral 87 is a cleaning blade to remove a magnetic brush that has passed through developing region A from the developing sleeve 81. Numeral 88 is a developer reservoir. Numeral 89 is a casing. A bias voltage in which DC and AC voltages are superimposed is impressed upon the developing sleeve 81 through protective resistor R1 by DC bias power source E1 and AC bias power source E2. A bias voltage is impressed upon the electrode 85*a* of the plate-shaped electrode 85 through protective resistor R2 by DE bias power source E3.

The developing device of the present invention is characterized in that: the first oscillating electric field is generated between the electrode 85*a* integrally provided on the insulating member 85*b* coming into contact with the developing sleeve 81, and the developing sleeve 81; the intensity of the first oscillating electric field is stronger than that of the second oscillating electric field that is formed between the photoreceptor belt 1 and the developing sleeve 81 in a conventional device; and an electric field is formed between the photoreceptor belt 1 and the electrode 85*a* in order to move the toner to the photoreceptor belt 1. Preferably, the electrode 85*a* is set in a position where a distance from the position to the developing sleeve 81 is 0.2 to 0.6 of $d_1$, where $d_1$ is a distance from the developing sleeve 81 to the photoreceptor belt 1.

Figure 1B:
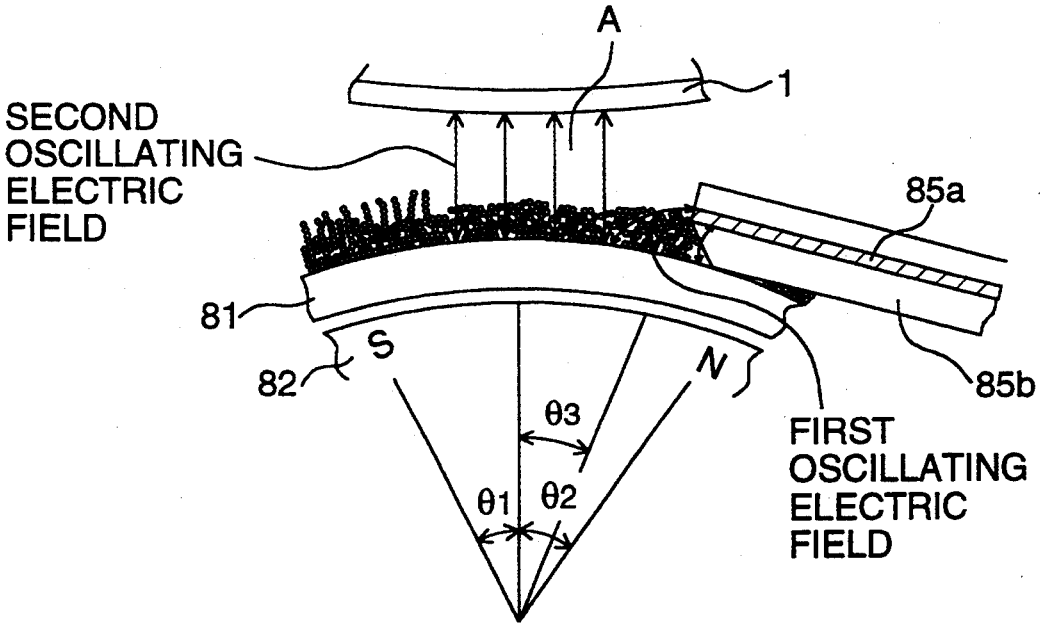

FIG. 1(*b*) is an enlarged sectional view showing a portion around developing region A. As shown in FIG. 1(*a*), a bias voltage in which an AC voltage is superimposed on a DC voltage is impressed upon the developing sleeve 81, and a DC bias voltage is impressed upon the electrode 85. A tip of the electrode 85 is chamfered on the developing sleeve side so that a V-shaped cut-out portion can be formed in order to provide a space in which a toner cloud is generated between the electrode 85 and the developing sleeve 81. As shown in FIG. 1(b), this cut-out portion is provided downstream with respect to magnetic angle $\theta_2$ on the upstream side. In this connection, both sides and the tip of the electrode 85 are coated with insulating material. This structure is preferable even in the devices shown in FIGS. 2 and 3. In the color image forming apparatus described above, reversal-development is carried out with the photoreceptor belt 1 in which an OPC photoreceptor negatively charged is used. For example, in the case where the photoreceptor is charged at −800 V, a bias voltage of −(800 to 1500) V that is higher than the potential of the photoreceptor is impressed upon the electrode 85, and a bias voltage of −700 V is impressed upon the developing sleeve 81, wherein the bias voltage includes both DC and AC voltage components. The frequency of the AC voltage component is 100 Hz to 10 KHz, and preferably 1 to 5 KHz, and Peak to Peak of the AC voltage component is 200 to 4000 V. Since a voltage, the polarity of which is the same as that of toner, and the potential of which is higher than the potential of the photoreceptor, is impressed upon the electrode 85, no toner is deposited on the electrode, and a toner image formed on the photoreceptor is not adhered onto the electrode in the superimposing process. Since the electrode 85 is disposed close to the developing sleeve 81 compared with the photoreceptor belt 1, the intensity of the first oscillating electric field is stronger that that of the second oscillating electric field. In this case, it is preferable that the following equation is satisfied:

$$d_2=(0.2 \text{ to } 0.6)d_1$$

where $d_2$ is the closest gap between the electrode and the developing sleeve, and $d_1$ is the closest gap between the photoreceptor and the developing sleeve. In this embodiment, $d_1$ is preferably 0.2 to 1.0 mm.

By the action of this first oscillating electric field, toner particles are oscillated in the direction perpendicular to the line of electric force, so that the toner particles are separated from the carrier particles and become airborne. Therefore, a toner cloud can be sufficiently generated. The second oscillating electric field helps the toner cloud to fly toward a latent image on the photoreceptor belt 1, so that development can be uniformly performed.

In this case, it is important that the phase of the first oscillating electric field and that of the second oscillating electric field are the same. When the phases are the same, a surge is not caused in toner oscillation while development is being carried out. Moreover, the toner oscillation is not broken down by a strong electric field generated when the phase is changed.

The waveform of the aforementioned AC voltage component is not limited to a sine wave but it may be a rectangular wave or a triangular wave. The higher the voltage is, the more the magnetic brush of developer is oscillated, wherein the oscillation of the magnetic brush is dependent on the frequency of the voltage. When the magnetic brush is more strongly oscillated, the toner particles tend to separate from the carrier particles and fly easily. On the other hand, breakage of insulation tends to occur. The occurrence of fogging can be prevented by a DC component, and also the breakage of insulation can be prevented when the following measures are taken: the surface of the developing sleeve 81 is coated with insulating or semi-insulating material such as resin or oxide film; or the carrier particles of the developer are made of insulating material as described later.

According to the developing device of the present invention, images of high quality can be developed in the following manner: the magnetic brush of two-component developer is maintained in a non-contact condition with respect to the photoreceptor belt 1; a toner cloud is made by the first and second oscillating electric field so that the toner particles travel toward the photoreceptor belt 1 and are selectively attracted onto an electrostatic latent image; the carrier particles are prevented from being adhered onto the surface of the photoreceptor belt 1; and accordingly fine toner and carrier particles can be used for the developing device. In this case, it is preferable to use a developer including the following carrier and toner particles.

In general, when the average particle size is large, a coarse magnetic brush is formed on the developing sleeve 81. Therefore, even when the magnetic brush is oscillated by the action of an electric field to develop an electrostatic latent image, an uneven toner image tends to be developed, and moreover the toner concentration is lowered in the position where the magnetic brush is formed. For that reason, development of high density can not be performed. In order to solve the aforementioned problems, it is effective to reduce the average size of the magnetic carrier particles. According to the results of experiments made by the inventors, the aforementioned problems were not caused in the case where the weight average particle size was not more than 50 μm. However, when the particle size of magnetic carrier is too small, the carrier particles adhere onto the surface of the photoreceptor belt 1 together with the toner particles, and moreover they tend to become airborne. These phenomena are concerned with the intensity of the magnetic field activated to the carrier, and also concerned with the intensity of magnetization of the carrier. In general, when the weight average particle size of magnetic carrier is not more than 15 μm, the aforementioned tendency appears, and when the weight average particle size of magnetic carrier is not more than 5 μm, the aforementioned tendency becomes remarkable. Therefore, the weight average particle size of the magnetic carrier contained in developer D is preferably not more than 50 μm and not less than 5 μm, and more preferably the weight average particle size is not less than 15 μm. When the magnetic carrier particles are made spherical, the stirring property of toner and carrier particles and the conveyance property of developer D can be improved, and moreover the control property of toner charging can be also improved, so that the coagulation of toner particles and that of toner and carrier particles are difficult to occur. Accordingly, the magnetic carrier particles are preferably made spherical.

Examples of the material used for the aforementioned preferable magnetic carrier are as follows: a metal such as iron, chrome, nickel and cobalt; and a compound and alloy such as triiron tetraoxide, γ-ferric oxide, chrome dioxide, manganese dioxide, ferrite, and manganese-copper alloy, wherein the particles of the aforementioned ferromagnetic bodies are made spherical, or the surfaces of the ferromagnetic particles are coated with a resin such as styrene resin, silicon resin, fluorine resin, vinyl resin, ethylene resin, rosin resin, acrylate resin, polyamide resin, epoxy resin, and polyester resin. Alternatively, particles of resin in which fine particles of the magnetic body are dispersed, are made and subjected to an average size particle selection means of the prior art so as to select the particle size.

When the carrier particles are made spherical by using resin as described above, in addition to the aforementioned effect, the following effects can be also provided: the thickness of a developer layer formed on the developer carrier is made uniform; and a high bias voltage can be impressed upon the developer carrier. In other words, when the carrier particles are made spherical using resin, the following effects can be provided:

(1) In general, carrier particles are susceptible to magnetization in the direction of the major axis. However, when they are made spherical, the orientation is eliminated. Therefore, the developer layer is uniformly formed, and the occurrence of low resistance regions and non-uniform thickness can be prevented.

(2) Resistance of carrier particles can be increased, and edge portions, which are common in conventional carrier particles, can be removed, so that the electric field is not concentrated on the edge portions. As a result, even when a high bias voltage is impressed upon the developer carrier, the following problems can be prevented: discharging occurs on the surfaces of the electrode and photoreceptor belt 1, and therefore the electrostatic latent image is disturbed and further the bias voltage is broken down. When a high bias voltage is impressed in the manner described above, the effect of the present invention can be sufficiently exerted under the oscillating electric field. In order to make the carrier particles spherical, which is effective as described above, wax is applied, however, the aforementioned resins are preferably applied to the carrier particles to improve their endurance. In order to provide the aforementioned effects, the magnetic carrier particles are preferably provided With insulating properties, and the resistivity of the spherical carrier particles is preferably not less than $10^8$ Ωcm, and more preferably not less than $10^{13}$ Ωcm. The resistivity can be measured in the following manner: the particles are put into a container, the sectional area of which is 0.5 $cm^2$; then the particles are tapped; while a load of 1 $kg/cm^2$ is applied onto the particles, a voltage is impressed between the load and a bottom electrode so that an electrical field of 1000 V/cm can be generated; and the electrical current is measured. In the case where the resistivity is low, electrical charges are given to the carrier particles when a bias voltage is impressed upon the developer carrier, so that the carrier particles tend to be deposited on the photoreceptor belt 1 surface, and further a breakdown of the bias voltage tends to be caused.

Requirements for the magnetic carrier are as follows: the magnetic carrier particles are made spherical in such a manner that the ratio of the major axis to the minor axis is not more than 3; there are no projections such as a needle-like portion and an edge portion; and the resistivity is not less than $10^8$ Ωcm, and more preferably not less than $10^{13}$ Ωcm.

The aforementioned spherical magnetic carrier particles of high resistance coated with resin are manufactured in the following manner:

Configuration of the particles should be as spherical as possible. In the case of the carrier in which magnetic fine particles are dispersed, particles should be as fine as possible, and after dispersed resin particles have been formed, they are subjected to spherical processing, or dispersed resin particles are manufactured by the spray-dry method.

Next, the properties of toner will be described as follows. When the average particle size of toner is reduced, the quantity of charged electricity of toner particles is qualitatively reduced proportionally to the square of the particle size, so that deposition force such as Van der Waals force is relatively increased, the toner particles tend to become airborne, and it becomes difficult for the toner particles to separate from the carrier particles. In a conventional magnetic brush developing method, when the average particle size is not more than 10 μm, the aforementioned problems become remarkable. In the developing device of the present invention, the above problems are solved when development is carried out by the magnetic brush under the condition of the double oscillating electric field. That is, the development is conducted in the following manner: the toner particles adhered onto the magnetic brush are strongly oscillated by the action of the first oscillating electric field so that they are easily separated from the magnetic brush so as to form a toner cloud; and the toner particles are conveyed to developing region A close to this toner cloud, and these toner particles are precisely attracted onto an electrostatic latent image in the second oscillating electric field. Moreover, the following case does not occur: toner particles of which the charging amount is low adhere onto the image and non-image portions. Toner particles do not rub the photoreceptor belt 1, either. Therefore, adhesion of toner particles caused by triboelectricity can be eliminated. As a result of the foregoing, toner particles, the particle size of which is about 1 μm, can be used for the developing device. Since the oscillating electric field reduces the joint force between toner and carrier particles, the carrier particles accompanied by the toner particles are not deposited on the photoreceptor belt 1. Moreover, the magnetic brush is separated from the photoreceptor 1 surface and maintained in non-contact condition. When the toner particles having a large electrical charge compared with the electrical charge of the carrier particles selectively move onto the electrostatic latent image under the oscillating condition, adhesion of the carrier particles onto the photoreceptor belt 1 can be greatly reduced.

As described before, when the average particle size of toner is increased, formed images become rough. In the case of development in which the resolving power is capable of reproducing thin lines disposed at regular intervals of 10 lines/mm, toner, the average particle size of which, is about 20 μm can be used. However, when toner of minute particles, the average particle size of which is 1 to 5 μm, is used, the resolving power is remarkably improved, and the contrast can be precisely reproduced, so that images of high quality can be provided. Consequently, the appropriate toner particle size is not more than 10 μm, and more preferably 1 to 5 μm. In order to allow the toner particles to quickly follow the changes of the electric field, it is preferable that the charging amount of toner particles is larger than 1 to 3 μC/g, and more preferably 3 to 30 μC/g. When the particle size is small, a large charging amount is required.

The aforementioned toner can be produced by a conventional method. That is, the toner can be produced in the same manner that conventional spherical and indefinite toner particles or conventional magnetic or non-magnetic toner particles are selected by an average particle size selecting means. Particularly, it is preferable that the toner particles contain minute magnetic particles. It is preferable that the amount of magnetic minute particles is not more than 60 wt %, and more particularly not exceeding 30 wt %. In the case where the toner particles contain magnetic particles, the toner particles are affected by the magnetic force generated by the developer carrier, so that a more uniform magnetic brush can be provided, and moreover the occurrence of fogging can be prevented and the toner particles do not become airborne. However, in the case where an excessively large amount of magnetic material is contained in the toner, the magnetic force generated between the toner and carrier particles is highly increased. As a result, sufficient developing density can not be provided. Moreover, the minute magnetic particles appear on the surface of toner particles. Therefore, it becomes difficult to control triboelectricity, and further the toner particles are susceptible to damage.

The foregoing will be summarized below. In the developing device of the present invention, preferable toner particles are described as follows. The toner particles are preferably made of resin, and composed of minute magnetic particles. Moreover, a coloring agent such as carbon, and a charging control agent are added to the toner particles, if necessary. The producing method is the same as a conventional one. The average particle size is not more than 20 μm, and preferably not more than 10 μm, and more preferably 1 to 5 μm.

For the developing device of the present invention, developer is preferably used in which spherical carrier particles and toner particles are mixed at the same ratio as that of a conventional two-component developer. When necessary, a fluidity improving agent to improve the fluidity of particles and a cleaning agent to clean the image carrier surface are mixed with the particles. Examples used for the fluidity improving agent are colloidal silica, silicon wax, metallic soap, and nonion surface active agent. Examples used for the cleaning agent are surface active agents such as fatty acid metallic salt, substitutional organic group silicon and fluorine.

In the aforementioned developing device, magnetic carrier was used, the particles of which were made spherical by a thermal method, and in the magnetic carrier, 50 wt % of minute ferrite particles were dispersed in resin, and the weight average particle size was 30 μm, the intensity of magnetization was 50 emu/g, and the electrical resistivity was $10^{14}$ cmΩ. In the aforementioned developing device, toner was also used, the particles of which were non-magnetic particles composed of 100 wt parts of styrene acrylic resin (Highmer p110 manufactured by Sanyo Kasei Co.) and 10 wt parts of color pigment. Development was carried out with the apparatus shown in FIG. 1 under the condition that a ratio of toner to carrier of developer D was 10 wt % in each developer reservoir.

In this case, the operating conditions were as follows. The photoreceptor belt 1 was an OPC photoreceptor, the circumferential speed was 180 mm/sec, the maximum voltage of an electrostatic latent image formed on the photoreceptor belt 1 was −800 V, the outer diameter of the developing sleeve 2 was 30 mm, the rotational speed was 150 rpm, the magnetic flux density of the NS poles of the magnetic body 82 opposed to development region A was 1200 gauss, $\theta_1=20°$, $\theta_2=30°$, the thickness of developer layer D was 0.4 mm, a gap between the developing sleeve 81 and the photoreceptor belt 1 was 0.7 mm, the bias voltage of DC component impressed upon the developing sleeve 81 was −700 V, and the AC voltage component was 4 Kz and 1000 V. The electrode was disposed at a position separated from the photoreceptor by 0.3. A DC voltage component of −1000 V was impressed upon the electrode, wherein the DC voltage was higher than the charging voltage of the photoreceptor, and its polarity was the same as that of the toner. In this connection, $\theta_3=20°$. In this example, developer D provided on the developing sleeve 81 was not contacted with the surface of the photoreceptor belt 1.

Development was conducted under the above conditions, and a color toner image was formed on the photoreceptor. The color toner image was transferred onto a transfer sheet by means of corona discharge, and then the transferred image was fixed by a fixing device provided with a heat roller, the surface temperature of which was 140° C. As a result, a recorded image of high quality was provided in which there was no edge effect or fogging and the density was very high. Successively, the image was recorded on 50000 sheets of recording papers. The resulting recorded images were excellent.

In the second example shown in FIG. 2, the operating conditions were as follows. The photoreceptor belt 1 was an OPC photoreceptor, the circumferential speed was 180 mm/sec, the maximum voltage of an electrostatic latent image formed on the photoreceptor belt 1 was −800 V, the outer diameter of the developing sleeve 2 was 30 mm, and its rotational speed was 150 rpm, the magnetic body 82 was composed of 8 poles and rotated at a speed of 1000 rpm, the magnetic flux density was 1200 gauss, the thickness of developer layer D was 0.4 mm, a gap between the developing sleeve 81 and the photoreceptor belt 1 was 0.7 mm, the bias voltage of DC component impressed upon the developing sleeve 81 was −700 V, and the AC voltage component was 4 Kz and 1000 V. The electrode was disposed in a position separated from the photoreceptor by 0.4. A DC voltage component of −1000 V was impressed upon the electrode, wherein the DC voltage was higher than the charging voltage of the photoreceptor, and its polarity was the same as that of the toner. In this connection, $\theta_3=20°$. In this example, developer D provided on the developing sleeve 81 was not contacted with the surface of the photoreceptor belt 1.

Development was conducted under the above conditions, and a color toner image was formed on the photoreceptor. The color toner image was transferred onto a transfer sheet by means of corona discharge, and then the transferred image was fixed by a fixing device provided with a heat roller, the surface temperature of which was 140° C. As a result, a recorded image of high quality was provided in which there was no edge effect or fogging and the density was very high. Successively, the image was recorded on 50000 recording papers. All the recorded images were excellent.

In the third example shown in FIG. 3, the operating conditions were as follows.

The photoreceptor belt 1 was an OPC photoreceptor, the circumferential speed was 180 mm/sec, the maximum voltage of an electrostatic latent image formed on the photoreceptor belt 1 was −800 V, the outer diameter of the developing sleeve 2 was 30 mm, the rotational speed was 150 rpm, the magnetic flux density of the SS poles of the magnetic body 82 opposed to development region A was 1200 gauss, $\theta_1=25°$, $\theta_2=25°$, the thickness of developer layer D was 0.4 mm, a gap between the developing sleeve 81 and the photoreceptor belt 1 was 0.7 mm, the bias voltage of DC component impressed upon the developing sleeve 81 was −700 V, and the AC voltage component was 4 Kz and 1000 V. The electrode was disposed in a position separated from the photoreceptor by 0.3. A DC voltage component of −1000 V was impressed upon the electrode, wherein the DC voltage was higher than the charging voltage of the photoreceptor, and its polarity was the same as that of the toner. In this connection, $\theta_3=15°$. In this example, developer D provided on the developing sleeve 81 was not contacted with the surface of the photoreceptor belt 1.

Development was conducted under the above conditions, and a color toner image was formed on the photoreceptor. The color toner image was transferred onto a transfer sheet by means of corona discharge, and then the transferred image was fixed by a fixing device provided with a heat roller, the surface temperature of which was 140° C. As a result, a recorded image of high quality was provided in which there was no edge effect or fogging and the density was very high. Successively, the image was recorded on 50000 sheets of recording papers. All the recorded images were excellent.

In the aforementioned examples, while a specific developing device was being operated, the developing sleeves of other developing devices were stopped and the supply of the AC bias to be impressed upon the developing sleeve was also stopped. That is, a bias voltage of a floating condition, or a bias voltage of the same polarity as that of the toner, or a bias voltage of a different polarity from that of the toner, was impressed. During image formation, a bias voltage, the polarity of which was the same as that of the toner, was maintained to be impressed upon the electrode. As a result of the foregoing, the toner was not moved from the toner image formed on the photoreceptor to the electrode.

In these examples, the electrode was constituted by an electrode plate of 100 μm thickness provided between urethane rubber sheets.

Figure 6:
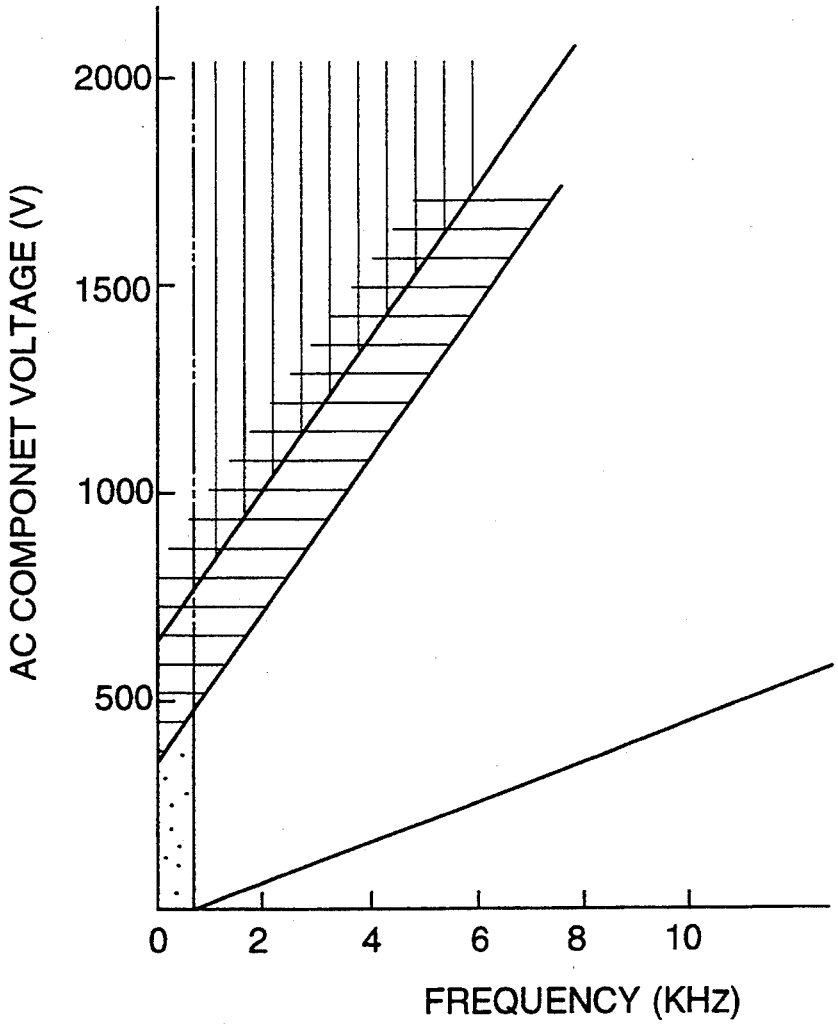
FIG. 6 is a graph showing a developing condition in the case where the AC component of bias voltage is changed in the example.

In the above examples, the same bias conditions were obtained. FIG. 6 is a graph showing a relation between the frequency and the voltage of the AC voltage component impressed upon the developing sleeve 81. In the graph shown in FIG. 6, in the hatched region including lateral lines, fogging tends to occur. In the hatched region including longitudinal lines, breakage of insulation tends to occur. In the hatched region including diagonal lines, image quality tends to be deteriorated. In the region not hatched, preferable images can be provided. As can be seen in the drawing, the region in which fogging tends to occur is changed in accordance with the change of the AC voltage component. In this connection, the waveform of the AC voltage component is not limited to a sine wave, but it may be a rectangular wave or a triangular wave. In a low frequency region that is dotted in the graph, the frequency is so low that unevenness tends to occur in the developed image.

If magnetic toner is used for the two-component developer in the above examples, a magnetic latent image can be visualized in the same developing condition.

As explained above, according to the developing device of the present invention, even when carrier, the average particle size of which is not more than 30 μm, and toner, the average particle size of which is not more than 10 μm, are used, images of high quality can be provided on which carrier particles are not deposited. Even when the developing device of the present invention is applied to a color image forming apparatus in which a multi-color toner image is formed on an image carrier and the formed multi-color image is transferred onto a transfer sheet in one operation, color mixture is not caused since a weak oscillating electric field can be used in the developing process. Therefore, an excellent developing device can be provided in which the developing efficiency is high and images of high quality without unevenness can be developed.

Next, an example will be explained in which the present invention is applied to one-component developer.

Figure 7A:
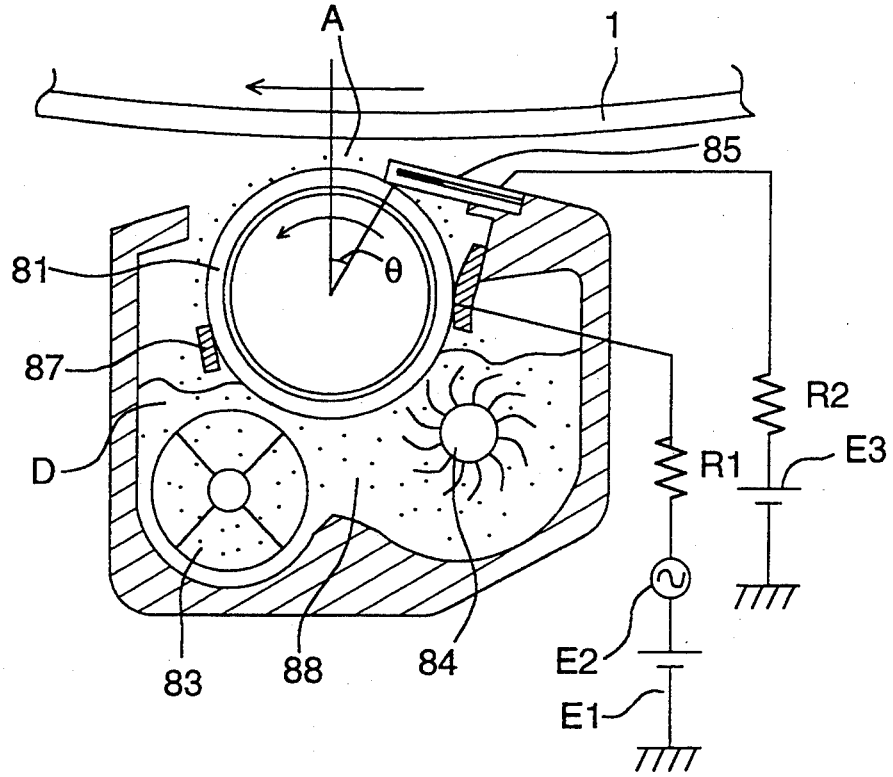
FIGS. 7*a* and 7*b* are sectional views showing an example of the developing device of the present invention, wherein the present invention is applied to one-component developer.
Figure 7B:
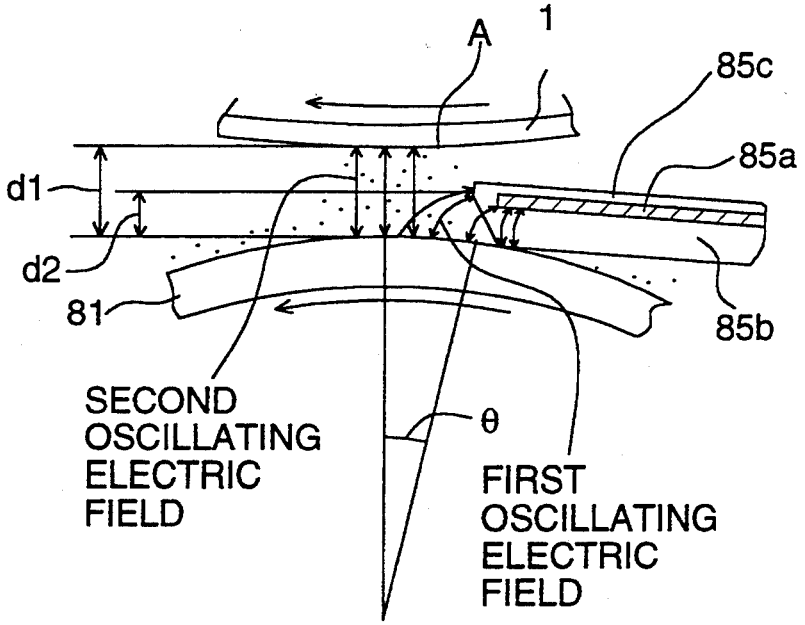

FIG. 7 is a sectional view schematic of a developing device of an example of the present invention. FIG. 7(*a*) is a sectional view of an example of the device of the present invention. Numeral 81 is a developing sleeve that is a rotatably supported developer carrier made of non-magnetic material such as aluminum and stainless steel, the surface of which is subjected to sand blasting so that the surface roughness measured according to JIS-B0610 is 1 to 2 μm. Numeral 83 is a stirring unit by which developer D is stirred so the components can be uniformly mixed. Numeral 84 is a fur brush to supply developer D to the developing sleeve 81. Numeral 86 is a regulating blade made of rubber that regulates the thickness of a developer layer on the developing sleeve 81. Numeral 85 is an electrode plate provided on the upstream side of developing region A for the purpose of forming an oscillating electric field. The electrode plate 85 is constituted in the following manner: the plate-shaped electrode 85*a* made of conductive material such as metal is integrally provided between the insulating members 85*b* and 85*c* made of insulating material such as rubber, wherein the insulating members 85*b* and 85*c* are disposed so that they come into contact with developer D on the developing sleeve 81; and the tip portion of the electrode plate 85 is coated with insulating material. A V-shaped cut-out portion is formed at the tip of the electrode plate 85 on the developing sleeve side, so that a space for generating a toner cloud can be provided between the electrode plate 85 and the developing sleeve 81. The layer of developer D, the thickness of which is regulated by the electrode plate 85, is moved when the developing sleeve 81 is rotated, and conveyed to developing region A. In this connection, the electrode plate 85 can be also used as the regulating blade 86 to regulate the thickness of the developer layer on the developing sleeve 81. A gap between the developing sleeve 81 and the electrode plate 85, and that between the developing sleeve 81 and the photoreceptor belt 1 are adjusted so that the developer layer formed on the developing sleeve 81 can not be contacted with the surface of the photoreceptor belt 1. Numeral 87 is a cleaning blade to remove from the developing sleeve 81 the developer that has passed through developing region A. Numeral 88 is a developer reservoir. Numeral 89 is a casing.

A bias voltage, in which a DC component generated by DC bias power source E1 and an. AC component generated by AC bias power source E2 are superimposed, is impressed upon the developing sleeve 81 through protective resister R1. A DC bias voltage is impressed upon the electrode 85*a* of the electrode plate 85 by DC bias power source E3 through protective resister R2.

According to the present invention, the first oscillating electric field is generated between the electrode 85*a* and the developing sleeve 81, wherein the electrode 85*a* is integrally provided on the insulating member 85*b* that comes into contact with the developer layer on the developing sleeve 81. Moreover, according to the present invention, the intensity of the first oscillating electric field is set to be higher than that of the second oscillating electric field formed in a conventional device between the photoreceptor belt 1 and the developing sleeve 81. Further, according to the present invention, an electric field to move the toner to the photoreceptor belt 1 is formed between the photoreceptor belt 1 and the electrode 85*a*.

FIG. 7(*b*) is an enlarged sectional view showing a region close to developing region A. As shown in FIG. 7(*a*), a bias voltage in which DC and AC components are superimposed is impressed upon the developing sleeve 81, and also a DC bias voltage is impressed upon the electrode plate 85. In the aforementioned color image forming apparatus, a negatively charged OPC photoreceptor is used for the photoreceptor belt 1 so that reversal-development is carried out. For example, when the photoreceptor is charged to be −800 V, voltage −(700 to 1000) V is impressed upon the electrode 85, and a bias voltage, in which a DC voltage component of −700 V and an AC voltage component are super imposed, is impressed upon the developing sleeve 81. The frequency of the AC component is 100 Hz to 10 KHz, and preferably 1 to 5 KHz. The voltage between the peaks is 200 to 4000 V.

As a result of the foregoing, a voltage, the absolute value of which is high, is impressed upon the electrode 85*a* of the electrode plate 85. Therefore, toner is not deposited on the electrode plate 85, and a toner image on the photoreceptor belt 1 does not adhere onto the electrode 85*a* in the image superimposing process. Since the electrode 85*a* is disposed close to the developing sleeve 81, that is, a distance between the electrode 85*a* and the developing sleeve 81 is shorter than that between the electrode 85*a* and the photoreceptor belt 1. Therefore, the intensity of the first oscillating electric field is higher than that of the second oscillating electronic field.

The closest gap $d_2$ between the electrode 85*a* and the developing sleeve 81 preferably satisfies the following equation with respect to the closest gap $d_1$ between the photoreceptor belt 1 and the developing sleeve 81.

$$d_2=(0.2 \text{ to } 0.6)d_1$$

In this connection, $d_1$ is 0.2 to 1.0 mm. Since the electrode is installed in the small developing region, angle $\theta$ formed between the point where the developing sleeve 81 and the photoreceptor belt 1 are opposed to each other, and the electrode 85*a*, is preferably 5° to 45° on the upstream side. The diameter of the developing sleeve 81 is preferably 10 to 30 mm.

Since toner particles are oscillated by the first oscillating electric field in a direction perpendicular to the lines of electric force, the toner particles are flown, so that a toner cloud can be sufficiently generated. The second electric field helps the toner cloud to fly to a latent image on the photoreceptor belt 1, so that uniform development can be conducted.

In this case, it is important that the phase of the first oscillating electric field and that of the second oscillating electronic field are the same. When the phases are the same, developing is carried out without causing a swell in toner oscillation. Also, electric breakdown is not caused by a strong electric field when the phase is changed.

The waveform of the AC voltage component is not limited to a sine wave but a rectangular or triangular wave can be used. Although toner oscillation is concerned with frequency, the higher the voltage is, the more the toner particles are oscillated. On the other hand, when the voltage is high, electric breakdown like lightning tends to occur. The occurrence of fogging is prevented by the DC component, and the electric breakdown is prevented when the surface of the developing sleeve 81 is coated with a film of resin or oxide so that an insulating condition or a semi-insulating condition can be provided.

As described above, images of high quality can be developed by the developing device of the present invention in the following manner: a developer layer of one-component developer is maintained in a non-contact condition with respect to the surface of the photoreceptor belt 1; a toner cloud is generated by the first and second oscillating electric field so that the toner particles are flown toward the photoreceptor belt 1 and selectively attracted onto an electrostatic latent image; and therefore minute toner particles can be used for the developing device of the present invention. For the developing device, a developer composed of the following non-magnetic toner particles is preferably used.

In general, when the average particle size of toner particles is reduced, the charging amount is reduced in proportional to the second power of the particle size, so that an adhesion force such as Van der Waals force is relatively increased. Therefore, the toner particles are strongly adhered onto the developing sleeve 81 and tend to fly toward the non-image portion. As a result of the foregoing, fogging tends to occur. When the conventional developer layer developing method is applied, the aforementioned problems are remarkably caused in the case where the average particle size is not more than 10 μm.

According to the developing device of the present invention, the aforementioned problems are solved by conducting development in the first and second oscillating electric fields. That is, development is carried out in the following manner: toner particles are strongly oscillated in the first oscillating electric field so that they are separated from the surface of the developing sleeve 81 and a toner cloud is formed; the toner particles are conveyed to developing region A close to this toner cloud; and the toner particles are accurately attracted onto an electrostatic latent image in the second oscillating electric field that is weaker than the first oscillating electric field. In this case, toner particles of which the charging amount is small are not attracted onto the image and non-image portions, and the toner particles are not rubbed by the photoreceptor belt 1. Therefore, the toner particles do not adhere on the surface of the photoreceptor belt 1, so that the toner particles of which the particle size is about 1 μm can be used for the developing device.

As described above, as the average particle size to toner is increased, the developed image becomes rough. In the case of common development, the resolution of which is represented by light lines disposed in parallel at regular intervals of 10 lines/mm, the toner, the average particle size of which is 20 μm, can be used. However, when the toner, the average particle size of which is 1 to 5 μm, is used, the resolution can be greatly improved, and the contrast can be precisely reproduced, so that images of high quality can be provided. For these reasons, the average particle size of toner is preferably not more than 10 μm, and more preferably 1 to 5 μm. In order for the toner particles to follow the electric field, it is preferable that the charging amount of toner particles is preferably 1 to 3 μC/g, and more preferably 3 to 30 μC/g. Especially when the particle size is small, it is necessary to provide a large charging amount to toner particles.

The aforementioned toner particles can be provided by the conventional method. That is, the conventional spherical or indefinite non-magnetic toner particles are selected by an average particle size selection means so as to obtain the aforementioned toner particles.

In the developing device of the present invention, the preferable toner is made of resin such as styrene resin, vinyl resin, ethyl resin, denatured rosin resin, acrylic resin, polyamide resin, epoxy resin, and polyester resin, and also the preferable toner is made of fatty acid wax such as palmitic acid and stearic acid. Moreover, color pigment and charging control agent are added if necessary. Using the aforementioned materials, the toner used for the present invention can be manufactured by the well known method of the prior art, and the average particle size is not more than 20 μm, and preferably not more than 10 mm, and more preferably 1 to 7 μm.

In the developing device of the present invention, developer including the aforementioned spherical non-magnetic toner particles is preferably used. When necessary, a fluidity agent to improve the fluidity of particles, and a cleaning agent to clean the surface of an image carrier are mixed in the developer. Colloidal silica, silicon varnish, metallic soap or non-ionic surface active agent can be used for the fluidity agent. Fatty acid, metallic salt, organic group replacement silicon or fluorine can be used for the surface active agent.

Toner including non-magnetic particles composed of 100 wt parts of styrene acrylic resin (Haimer up 110 manufactured by Sanyo Kasei Co.) and 10 wt parts of color pigment, the weight average particle size of which was 5 μm, was used for the developing device described above, and developing was carried out using the device shown in FIG. 7. In this case, the average charging amount of each toner particle was −5 μC/g.

In the color image forming apparatus shown in FIG. 2 provided with the aforementioned developing device, the operating conditions were as follows.

The photoreceptor belt 1 was an OPC photoreceptor, the circumferential speed was 180 mm/sec, the maximum voltage of an electrostatic latent image formed on the photoreceptor belt 1 was −800 V, the outer diameter of the developing sleeve 81 was 30 mm, the rotational speed was 150 rpm, the thickness of developer layer was 0.4 mm, a gap between the developing sleeve 81 and the photoreceptor belt 1 was 0.7 mm, the bias voltage of DC component impressed upon the developing sleeve 81 was −700 V, and the AC voltage component was 4 Kz and the peak to peal voltage was 1000 V. The electrode 85*a* was disposed in a position separated from the photoreceptor by 0.4. A DC voltage component of −1000 V was impressed upon the electrode. In this example, developer D provided on the developing sleeve 81 was not contacted with the surface of the photoreceptor belt 1.

Development was conducted under the above conditions, and a color toner image was formed on the photoreceptor. The color toner image was transferred onto a transfer sheet by means of corona discharge, and then the transferred image was fixed by a fixing device provided with a heat roller, the surface temperature of which was 140° C. As a result, a recorded image of high quality was provided in which there was no edge effect and fogging and the density was very high. Successively, the image was recorded on 50000 sheets of recording papers. As the result, all the recorded images were excellent.

In the aforementioned example, while a specific developing unit was being used, the rotation of the developing sleeve of another developing unit not used was stopped, and the supply of AC bias to be impressed upon the developing sleeve was also stopped. That is, the developing sleeve was maintained in a floating condition, or a bias voltage of the same polarity as that of toner or a bias voltage of different polarity was impressed. In this connection, during image formation, the voltage of the same polarity as that of toner was continuously impressed upon the electrode member. As a result of the foregoing, toner movement from the toner image on the photoreceptor to the electrode member was prevented.

In these examples, the electrode was constituted in such a manner that an electrode plate of 100 μm thickness was provided between urethane rubber sheets.

Figure 8:
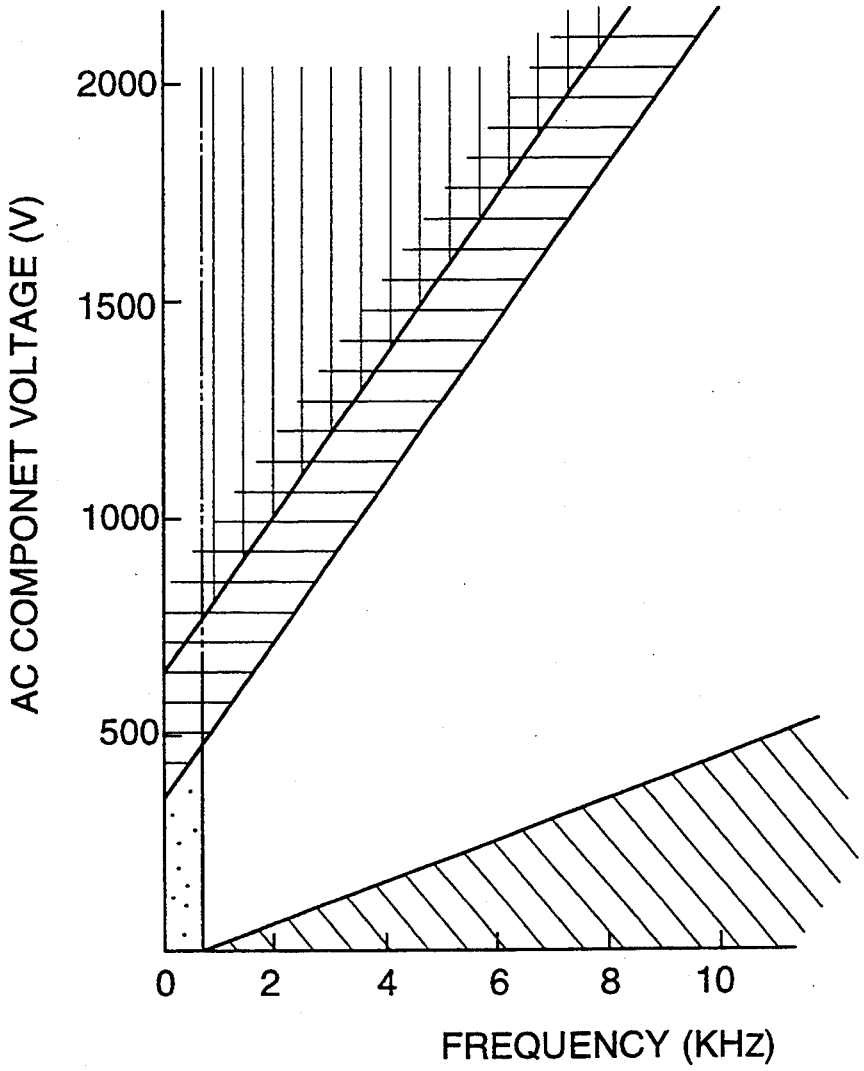
FIG. 8 is a graph showing a developing condition in the case where the AC component of bias voltage is changed in the example.

FIG. 8 is a graph showing a relation between the frequency and the voltage of AC voltage component impressed upon the developing sleeve 81, wherein one-component developer was used. The preferable range shown in this drawing was provided under the condition of $d_1$ and $d_2$ described before.

As explained above, according to the developing device of the present invention, even when the toner, the average particle size of which is not more than 10 μm, are used, images of high quality can be provided on which toner particles are not flown. Even when the developing device of the present invention is applied to a color image forming apparatus in which a multi-color toner image is formed on an image carrier and the formed multi-color image is transferred onto a transfer sheet in one operation, color mixture is not caused. Therefore, an excellent developing device can be provided in which the developing efficiency is high and images of high quality without unevenness can be developed.

Next, a preferable embodiment of the electrode applied for one-component and two-component developers described above will be explained as follows.

In a developing device having a control electrode provided between the image forming body and the developing sleeve, wherein the electrode is a plate-shaped member, it is preferable that the control electrode is installed so that the following inequality can be satisfied:

$$5° \leqq \theta \leqq 45°$$

where $\theta$ is defined as an angle formed between the control electrode and a vertical line connecting the center of the image forming body and that of the developing sleeve. Especially, it is preferable that the inequality $10° \leqq \theta \leqq 25°$ is satisfied.

It is preferable to provide a developing device in which the control electrode is disposed in the downstream with respect to a position where a distance between the electrode body and the developing sleeve is shortest. It is also preferable to provide a developing device in which the control electrode is disposed in the upstream with respect to the position where the distance between the electrode body and the developing sleeve is shortest, and in which the electrode body comes into contact with the developing sleeve with pressure on the upstream side.

Figure 9A:
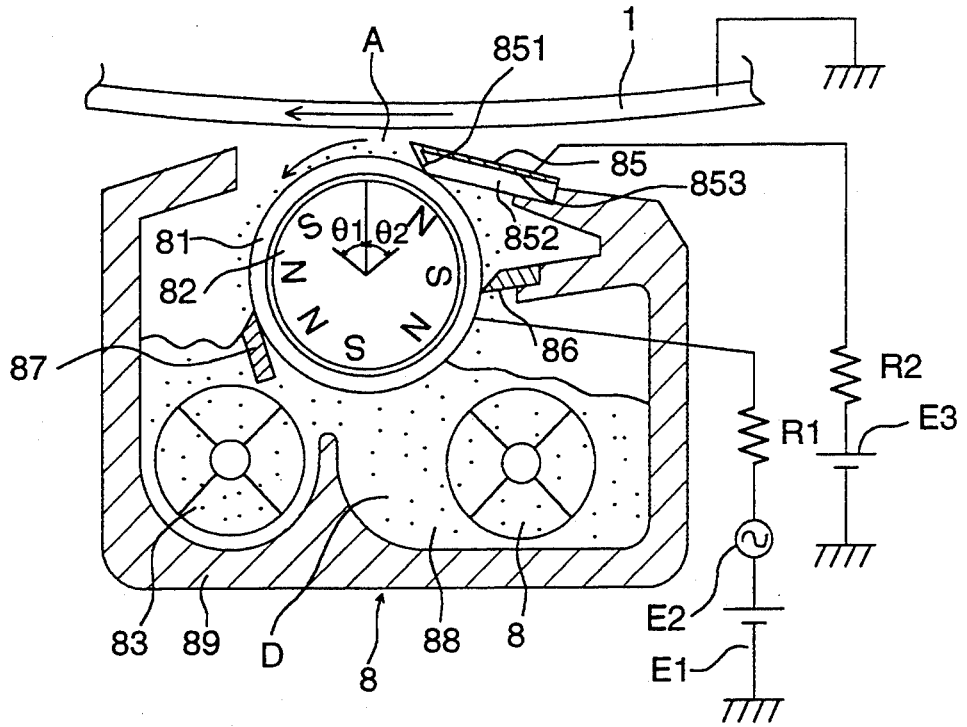
FIGS. 9*a* and 9*b* are sectional views showing a preferable example of the developing device of the present invention.
Figure 9B:
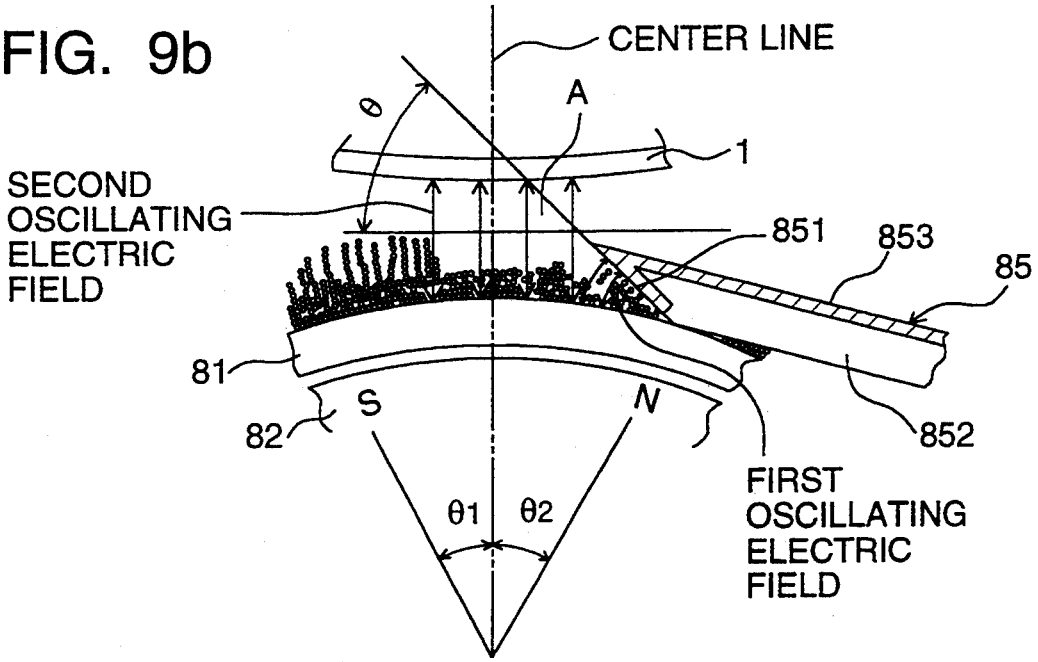

FIG. 9(*a*) is a sectional view schematic of the aforementioned preferable example, and FIG. 9(*b*) is an enlarged sectional view showing a portion close to developing region A shown in FIG. 9(*b*), wherein the invention is applied to a developing device in which two-component developer is used.

In FIG. 9, numeral 1 is a photoreceptor drum that is an image forming body in which a photoreceptor layer is provided on a conductive base that is grounded. Numeral 81 is a developing sleeve that is a developer carrier made of non-magnetic material such as aluminum and stainless steel rotated in the direction shown by an arrow. Numeral 82 is a magnetic body fixedly provided inside the developing sleeve 81 and a plurality of N and S poles are circumferentially provided on the surface. The N and S poles are usually magnetized to be 500 to 1500 gauss. Numeral 83 is a stirring unit that stirs developer D containing toner and magnetic carrier provided in a developer reservoir 88. The stirring unit 83 triboelectrically charges toner particles in developer D. Numeral 85 is a plate-shaped electrode body provided between the photoreceptor drum 1 and the developing sleeve 81 on the upstream side of developing region A. The electrode body 85 includes: a smoothing member 852 made of resilient insulating material such as rubber that comes into contact with developer D on the developing sleeve 81 or the surface of the photoreceptor drum 1 so as to further smooth the thickness of developer D layer; a control electrode 851 made of a conductive metallic plate that is embedded in or adhered to the tip portion of the smoothing member 852; and a terminal lead wire 853 to impress bias voltage upon the control electrode 851. Numeral 86 is a regulating blade to regulate the layer thickness of developer D. Numeral 87 is a cleaning blade to remove residual developer D from the surface of the developing sleeve 81 after developer D has passed through developing region A.

When the developing sleeve 81 is rotated, the layer of developer D, the thickness of which has been regulated by the regulating blade 86 and the smoothing member 852, is moved and conveyed to developing region A. A gap between the developing sleeve 81 and the smoothing member 852, and that between the developing sleeve 81 and the photoreceptor drum 1 are adjusted so that the developer D layer formed on the developing sleeve 81 can not be contacted with the surface of the photoreceptor drum 1.

A bias voltage, in which a DC component generated by DC bias power source E1 and an AC component generated by AC bias power source E2 are superimposed, is impressed upon the developing sleeve 81 through protective resister R1. A bias voltage, the polarity of which is the same as that of toner, is impressed upon the control electrode 851 by DC bias power source E3 through protective resister R2.

In a conventional developing device, even when the layer thickness of developer D is regulated by the regulating blade 86 so that the thickness can be constant, the layer thickness tends to be irregular. For that reason, when a magnetic pole of the magnetic body 82 is disposed in a position where a distance between the developing sleeve 81 and the photoreceptor drum 1 is shortest as in the case of a conventional developing device, the layer of developer D is raised at this point, so that the irregularity of layer thickness is emphasized. Accordingly, it becomes difficult to stably develop images of sufficient density without the occurrence of fogging. In the case where the layer thickness is reduced so that the developer layer can not be contacted with the surface of the photoreceptor drum 1, it is necessary to reduce a gap between the regulating blade 86 and the developing sleeve 81, and coagulation of dust and toner tends to occur and the regulating portion is blocked.

Therefore, in the developing device of the present invention, the N and S poles are not disposed in a position where a distance between the developing sleeve 81 and the photoreceptor drum 1 is shortest. As a result of the foregoing, a horizontal magnetic field is formed in developing region A, and the bristles of the developer layer are not raised but they are laid down. Due to the forgoing, (1) a developer layer of uniform thickness can be realized in developing region A, and (2) even when the gap between the regulating blade 86 and the developing sleeve 81 is extended, a thin developer layer can be realized in developing region A, so that a stable developing operation can be carried out without being affected by the irregularity of layer thickness.

It is preferable that the N and S poles are disposed in a range of 5° to 45° with respect to a center line connecting the center of the photoreceptor drum 1 and that of the developing sleeve 81. More preferably, the N and S poles are disposed in such a manner that the inequality $\theta_1 \leqq \theta_2$ is satisfied, wherein the opening angle of the center line is $\theta_1$ on the downstream side and $\theta_2$ on the upstream side. Moreover, it is preferable that the magnetic flux density of an N magnetic pole (or S magnetic pole) disposed in a position of opening angle $\theta_1$ on the downstream side is high so that a strong magnetic field can be generated on the downstream side of developing region A. Moreover, it is preferable that the diameter of the developing sleeve 81 is reduced so that the bristles of developer D formed in a position separate from the center line can not be contacted with the surface of the photoreceptor drum 1. The preferable range of the diameter of the developing sleeve 81 is 40 to 10 mm. It is preferable that the diameter of the photoreceptor drum 1 is also reduced, and the preferable range is from 30 to 2000 mm. In the case where a belt-shaped photoreceptor is utilized, a belt drive roller may be provided in developing region A so that the aforementioned conditions can be satisfied.

In the developing device of the present invention, the smoothing member 852 to regulate the upper surface of the developer layer is provided in a position where a distance between the developing sleeve 81 and the photoreceptor drum 1 is shortest, and the regulating position of the smoothing member 852 is located in a position where the S magnetic pole (or N magnetic pole) is disposed, wherein the S magnetic pole (or N magnetic pole) is located in a position of opening angle $\theta_2$. As a result of the foregoing, the developer layer thickness can be further reduced in developing region A. Consequently, images of sufficiently high density without fogging can be developed under an oscillating electric field.

Bristles of the developer D layer provided on the developing sleeve 81 are raised in a position where the N and S magnetic poles are disposed inside. In the case where the thickness of developer D layer regulated by the regulating blade 86 is not uniform, the irregularity tends to be emphasized in a position where the bristles are raised. Accordingly, in the case where the N and S magnetic poles are provided in a position where a distance between the developing sleeve 81 and the photoreceptor drum 1 is shortest, a condition in which the magnetic brush rubs the photoreceptor drum 1 is greatly changed in the magnetic brush developing method, so that fogging and image collapsing are caused. In the case of non-contact developing method in which the developer D layer is not contacted with the photoreceptor drum 1 so that the formed images are less susceptible to fogging and collapsing, a gap between the developing sleeve 81 and the photoreceptor drum 1 must be larger than that of a device in which the magnetic body 82 is rotated. When a large gap is formed, toner fly can not be sufficiently controlled by the oscillating electric field. Therefore, it is difficult to provide a uniform and sufficient developing density. In order to solve the problems, in this embodiment as shown in FIG. 9, the N and S magnetic poles are disposed in a position separate from a center line position where a distance between the developing sleeve 81 and the photoreceptor drum 1 is shortest. As a result of the foregoing, the direction of the magnetic field becomes horizontal in developing region A, that is, the direction of the magnetic field coincides with the tangential direction. Accordingly, a thin developer layer is formed without raising bristles. Therefore, the irregularity of layer thickness is not emphasized, and development is stably and uniformly carried out.

On the other hand, it can be considered to smooth the irregularity of layer thickness of developer D with a smoothing plate. In this case, it is effective to provide the smoothing plate in a position where the irregularity of layer thickness is emphasized. Therefore, as shown in FIG. 9, in a position of the S magnetic pole (or the N magnetic pole) on the upstream side with respect to the center line of the N and S magnetic poles that are disposed in a position separate from the position in which a distance between the developing sleeve 81 and the photoreceptor drum 1 is shortest, an upper surface of the layer of developer D is smoothed by the smoothing member 852. As a result, stripe marks caused when developer D is blocked in a position of the regulating blade 86 can be eliminated and the layer thickness of developer D becomes remarkably uniform in developing region A. In the example shown in FIG. 9, a smoothing position of the smoothing member 852 is set a little on the downstream side with respect to the positions of the N and S magnetic poles that are disposed on the upstream side of the center line. The smoothing member 852 is preferably made of insulating material that can facilitate triboelectrical charging caused between toner and carrier. The material is not limited to that, but any material can be applied as long as it can be maintained in a floating condition, and discharging and leakage can be prevented even when the electrical potential becomes the same as that of the developer D layer and the developing sleeve 81.

According to the present invention, the first oscillating electric field is generated between the control electrode 851 and the developing sleeve 81, wherein the control electrode 851 is integrally provided on the smoothing member 852 that comes into contact with the developer D layer on the developing sleeve 81. Moreover, according to the present invention, the intensity of the first oscillating electric field is set to be higher than that of the second oscillating electric field formed in a conventional device between the photoreceptor belt 1 and the developing sleeve 81. Further, according to the present invention, an electric field to move the toner to the photoreceptor drum 1 is formed between the photoreceptor drum 1 and the control electrode 851.

FIG. 7(*b*) is an enlarged sectional view showing a portion close to developing region A. As shown in FIG. 9(*b*), the control electrode 851 is characterized in that: an angle $\theta$ (this angle $\theta$ is defined as an oblique angle)

formed between the extension line of the control electrode and the vertical center line satisfies the inequality $5° \leqq \theta \leqq 45°$, so that a toner oscillating space that is spread toward developing region A is formed. The value of $\theta$ is preferably in a range of $10° \leqq \theta \leqq 25°$.

When the value of $\theta$ is small, a toner cloud is not effectively discharged into the developing sleeve. On the other hand, when the value of $\theta$ is large, the toner cloud is directly blown onto the photoreceptor, so that fogging is caused on an image.

A bias voltage in which an AC component is superimposed on a DC component is impressed upon the developing sleeve 81 as shown in FIG. 9(*a*). A DC bias voltage is impressed upon the control electrode 851. For example, in the case where reversal development is carried out using the photoreceptor drum 1 having an OPC photoreceptor layer that can be negatively charged and also using developer D, the toner of which is negatively charged, for example, when the photoreceptor is charged to be −800 V, a negative voltage of −(800 to 1500) V, the absolute value of which is larger than the potential of the photoreceptor, is impressed upon the control electrode 851. A bias voltage is impressed upon the developing sleeve 81, wherein the bias voltage of composed of a DC voltage component of −700 V, and an AC component, the frequency of which is 100 to 10 KHz, preferably 1 to 5 KHz, and the peak to peak voltage of which is 200 to 4000 V. As a result of the foregoing, the control electrode 851 is impressed with a voltage, the absolute value of which is larger than that of a voltage impressed upon the developing sleeve 81, and the polarity of which is the same as that of the toner. Therefore, toner does not adhere onto the control electrode 851, and toner on the toner image formed on the photoreceptor drum 1 does not adhere onto the control electrode 851, either. Since the control electrode 851 is disposed close to the developing sleeve 81, that is, a distance between the control electrode 851 and the developing sleeve 81 is shorter than that between the control electrode 851 and the photoreceptor drum 1. Therefore, the intensity of the first oscillating electric field is higher than that of the second oscillating electronic field. Moreover, the phases of the first and second oscillating electric fields are the same since they are generated from AC bias power source E2.

In this oscillating electric field, toner particles are oscillated in the oscillating space in a direction perpendicular to the electric lines of force. Therefore, the toner is flown and a toner cloud can be sufficiently generated. The second oscillating electric field, the phase of which is the same as that of the first oscillating electric field, helps the toner cloud to fly toward an electrostatic latent image on the photoreceptor drum 1, so that uniform development can be carried out.

In this case, it is important that the phase of the first oscillating electric field and that of-the second oscillating electric field are the same. When they are the same, development is carried out without causing a swell in toner oscillation. Also, electric breakdown is not caused by a strong electric field when the phase is changed.

The waveform of the AC voltage component is not limited to a sine wave but a rectangular or triangular wave can be used. Although toner oscillation is concerned with frequency, the higher the voltage is, the more the toner particles are oscillated. On the other hand, when the voltage is high, electric breakdown like lightning tends to occur. The occurrence of fogging is prevented by the DC component, and the electric breakdown is prevented when the surface of the developing sleeve 81 is coated with a film of resin or oxide so that an insulating condition or a semi-insulating condition can be provided.

Figure 10A:
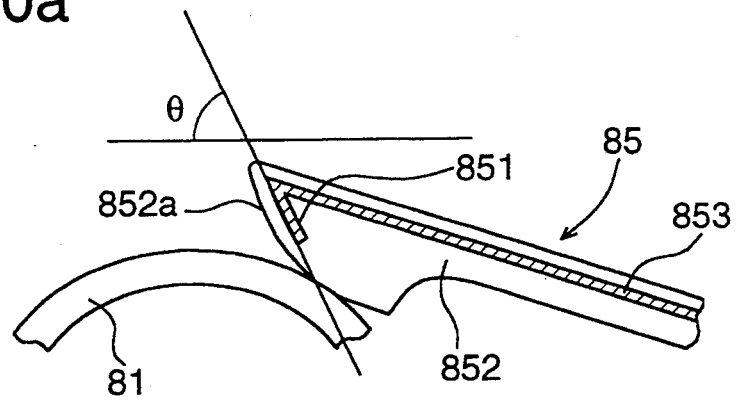
FIGS. 10*a*, 10*b* and 10*c* are sectional views showing another example of the electrode of the developing device of the present invention.
Figure 10B:
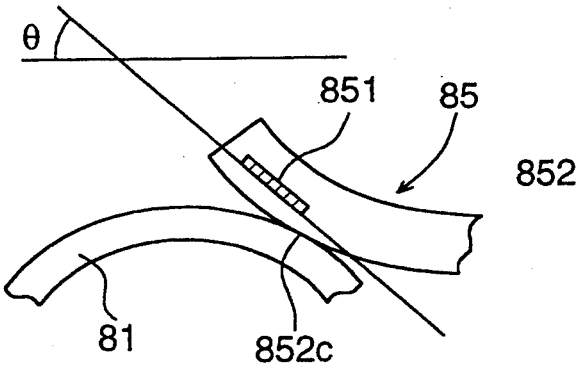
Figure 10C:
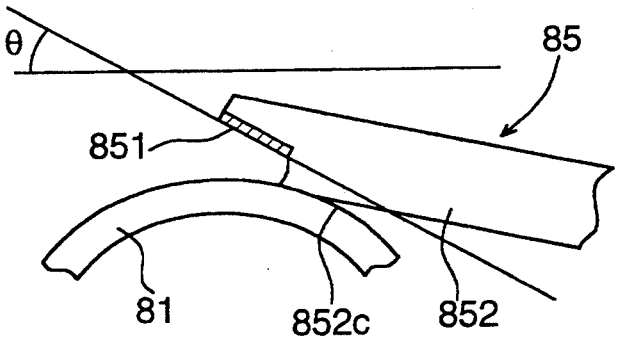

FIGS. 10(*a*) to 10(*c*) are partial sectional view showing other examples of the electrode 85 of the present invention. In FIG. 10(*a*), is shown a smoothing member 852 constituted in the following manner: the tip portion of the smoothing member 852 is thick; the lower surface 852*a* is curved; and the control electrode 851 is embedded in the smoothing member 852. In this structure, oblique angle $\theta$ is defined as an angle formed between a tangential line of the center of the control electrode 851 and the aforementioned vertical line.

A control electrode 853 connected with the control electrode 851 does not function for the purpose of generating a toner cloud.

In FIG. 10(*b*), is shown a smoothing member 852 that is pressed against the developing sleeve 81 by the resilience. In FIG. 2(*c*), is shown a smoothing member 852 in which a lower portion of the smoothing member 852 is removed from the tip portion located on the tip side with respect to the pressing portion 852*c*. In the examples shown in FIGS. 9 and 10, the control electrode 851 is disposed on the developing region A side with respect to the pressing portion 852*c*, that is on the downstream side of the developing sleeve 81. As a result, the occurrence of a toner cloud can be prevented.

Figure 11A:
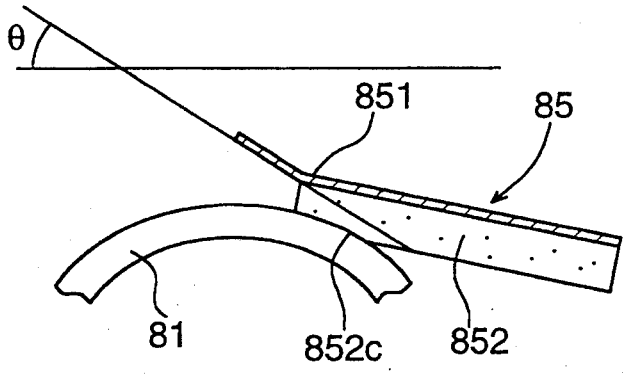
FIGS. 11*a* and 11*b* are sectional views showing a further example of the electrode of the developing device of the present invention.
Figure 11B:
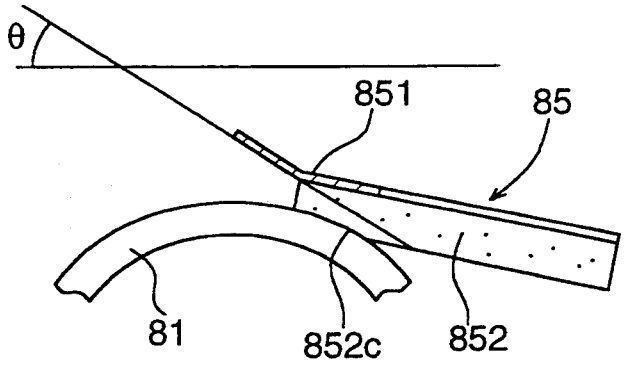

FIG. 11(*a*) is a view showing anther example of the electrode 85. A smoothing member 852 is made of sponge-like urethane resin, and the control electrode 851 is mounted on the upper portion of the pressing portion 852*c*. In this case, the control electrode 851 is provided on the upstream side of the developing sleeve 81 with respect to the pressing portion 852*c*. In this case, in order to prevent for a toner cloud to be generated on the upstream side with respect to the pressing portion 852*c* and also in order to prevent toner from flying, in a portion of the control electrode 851 on the upstream side with respect to the pressing portion 852*c*, a layer of developer D is pressed by the smoothing member 852. In the upstream portion of the pressing region, the electrode 851 is sufficiently separate from the developing sleeve in the non-pressing region, so that a toner cloud is not generated. FIG. 11(*b*) shows a structure in which the length of the electrode 851 is further reduced. In this case, the electrode is set in such a manner that it is in a region in which the smoothing member 852 presses. A portion of the control electrode 851 not covered with the smoothing member 852 is preferably coated with insulating synthetic resin so that the occurrence of discharged can be prevented.

Figure 12A:
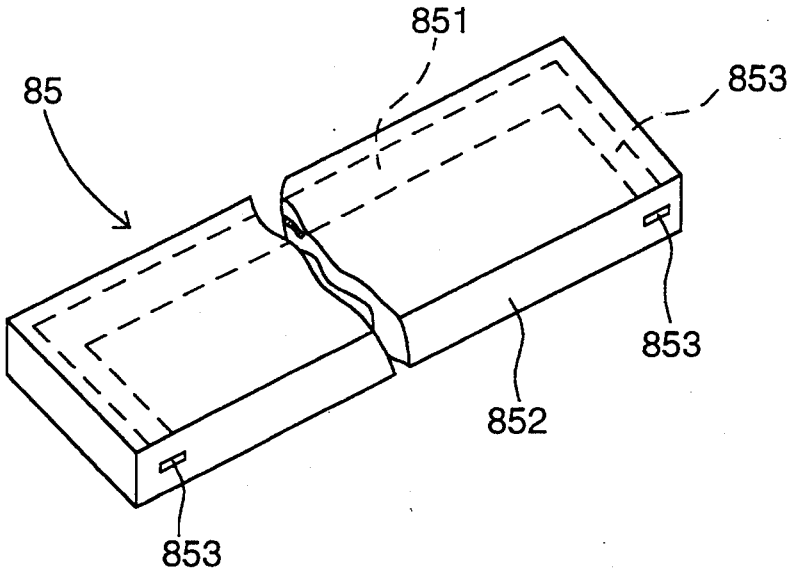
FIGS. 12*a* and 12*b* are perspective views showing the structure of the electrode of the present invention.
Figure 12B:
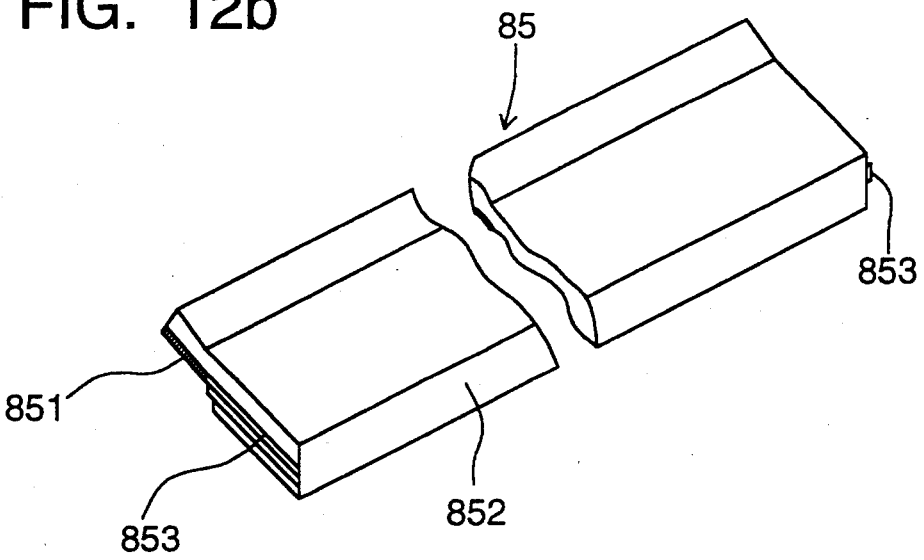

FIG. 12 is a perspective view showing the structure of the electrode 85. FIG. 12(*a*) shows a case in which the terminal lead wire 851 of the control electrode 851 shown in FIG. 10(*b*) is embedded in the smoothing member 852. FIG. 12(*b*) shows a case in which the terminal lead wire 851 of the control electrode 851 shown in FIGS. 9, 10(*c*) and 11 is provided on the side of the smoothing member 852.

In the above example, while developing operations are not conducted, the rotation of the developing sleeve 81 is stopped, and an AC bias is not impressed upon the developing sleeve 81. That is, the developing sleeve 81 is maintained in a floating condition, or impressed with a bias voltage, the polarity of which is the same as or different from that of the toner. In this connection, in order to prevent the adhesion of toner, the control electrode is impressed with a voltage, the polarity of which is the same as that of the toner, in the same manner as image formation. Otherwise, the control electrode 851 is maintained in a floating condition so as to prevent the adhesion of toner.

According to the developing device of the present invention, a uniformly thin layer of developer D can be stably formed in the following manner: the control electrode 851 is inclined so that a toner oscillating space is formed; the magnetic poles fixedly provided inside the developing sleeve 81 are disposed separately from a position where a distance between the developing sleeve 81 and the photoreceptor drum 1 is shortest; the layer of developer D moving in accordance with the rotation of the developing sleeve 81 is maintained in developing region A by the action of the horizontal magnetic field component; and the upper surface of the layer of developer D is smoothed by the smoothing member 852 at a position before the aforementioned developing region A. Minute particles of toner and carrier can be applied to the developing device of the present invention in the following manner: a toner cloud is sufficiently generated by the first oscillating electric field in the aforementioned oscillating space so that toner can be flown toward the photoreceptor drum 1 and selectively deposited on an electrostatic latent image, and therefore carrier particles are not deposited on the surface of the photoreceptor drum 1. As a result of the foregoing image of high quality can be formed. In this case, developer D containing the following carrier and toner is preferably used.

This example was applied under the following conditions.

An OPC photoreceptor was used for the photoreceptor drum 1. The circumferential speed of the photoreceptor drum 1 was 180 mm/sec. The charging potential of an electrostatic latent image formed on the photoreceptor drum 1 was −800 V. The potential of the exposure portion was −50 V. The outer diameter of the developing sleeve 81 was 30 mm, and its rotational speed was 150 rpm. The magnetic flux density of the magnetic poles of the magnetic body 82 was 1200 gauss. Thickness of the layer of developer D was 0.4 mm. The gap between the developing sleeve 81 and the photoreceptor drum 1 was 0.7 mm. Angle formed by the center line of the control electrode 851 and the vertical line was 25°. Bias voltage of −900 V, the polarity of which was the same as that of charged toner, was impressed upon the photoreceptor drum 1. Bias voltage of 1000 V, the DC component of which was −700 V and the AC component of which was 2 KHz, was impressed upon the developing sleeve 81.

Under the aforementioned conditions, the formed electrostatic latent image was subjected to reversal development, and the developed image was transferred onto a regular transfer paper by means of corona discharge. The transferred image was fixed by a heat roller fixing device, the surface temperature of which was 140° C. As a result of the foregoing operation, very clear images of high density without edge effect and fogging were provided. Successively 50000 copies were made, and excellent images were formed on all of the copies.

In the developing device explained above, two-component developer was used. In a developing device in which one-component developer is used, excellently recorded images can be formed using the electrode body 85 including the controlling electrode 851 and smoothing member 852 composed in the approximately same manner except for the magnetic body 82.

The developing device of the present invention is especially suitable for reversal-development. It can be applied to not only an electrophotographic recording device but also a recording device of electrostatic recording method in which a multi-stylus electrode is used.

As explained above, the developing device of the present invention is constituted in the following manner: an electrode made of resilient insulating material, the tip portion of which is provided with a control electrode, is disposed in the upstream of the developing region; an oscillating space is formed in such a manner that the control electrode is inclined so that a portion of the control electrode close to the developing region is separate from the circumferential surface of the developing sleeve; and a bias voltage of the same polarity as that of toner is impressed upon the electrode. As a result of the foregoing, even when minute particles of toner is used, the average particle size of which is 3 to 10 μm, a developing device can be provided in which the developing efficiency is high, and clear images of high quality without unevenness and fogging can be provided.

What is claimed is:

1. A non-contact type developing apparatus for developing an electrostatic latent image formed on a photoreceptor with developer containing toner, comprising:

a developing sleeve disposed to face the photoreceptor so that a developing region is formed between the developing sleeve and the photoreceptor, wherein the developer including a toner is attracted on the developing sleeve so that a developer layer is formed on the developing sleeve and the developing is conveyed in a conveying direction to the developing region;

an insulating plate member placed between the photoreceptor and the developing sleeve and positioned upstream of the developing region when viewed in relation to the conveying direction, a part of the plate member being arranged to be brought in contact with the developer layer on the developing sleeve so that the developer layer does not contact the photoreceptor in the developing region;

a conductive electrode member fixed to the plate member so that the electrode member is positioned between the photoreceptor and the developing sleeve; and a bias member for forming a first oscillating electric field between the electrode member and the developing sleeve, whereby the toner in the developer is oscillated between the plate member and the developing sleeve, the bias member further forming a second oscillating electric field between the photoreceptor and the developing sleeve, whereby the toner is caused to fly from the developer layer to the photoreceptor, the bias member being arranged to adjust an electric potential of each of the photoreceptor, the developing sleeve and the electrode member so that the first oscillating electric field is stronger than the second oscillating electric field and wherein another electric field is formed between the electrode member and the photoreceptor such that the toner in the developer layer is moved in a direction from the electrode member to the photoreceptor, and wherein a phase of an AC component of the first oscillating electric field is the same as a phase of an AC component of the second oscillating electric field.

2. The apparatus of claim 1, wherein the first and second oscillating electric fields each comprise an AC component and a DC component, and the another electric field between the electrode member and the photoreceptor only has a DC component.

3. The apparatus of claim 1, wherein the developer is a two component type developer including carrier particles and toner particles.

4. The apparatus of claim 1, wherein the developer is a one component type developer.

5. The apparatus of claim 1, wherein the electrode member includes a control electrode which is disposed downstream of the contact portion between the developing sleeve and the plate member when viewed in said conveying direction.

6. The apparatus of claim 5, wherein the plate member is pressed onto the developing sleeve at the contact portion.

7. A non-contact developing apparatus for developing an electrostatic latent image formed on a photoreceptor with developer containing toner, comprising:

a developing sleeve disposed to face the photoreceptor so that a developing region is formed between the developing sleeve and the photoreceptor, wherein a developer including a toner is attracted on the developing sleeve so that a developer layer is formed on said developing sleeve and the developer is conveyed in a conveying direction to the developing region;

an insulating plate member placed between the photoreceptor and the developing sleeve and positioned upstream of the developing region when viewed in the conveying direction, a part of the plate member being arranged to be brought in contact with the developer layer on the developing sleeve so that the developer layer does not contact the photoreceptor in the developing region;

a conductive electrode member fixed to the plate member so that the electrode member is positioned between the photoreceptor and the developing sleeve; and a bias member for forming a first oscillating electric field between the electrode member and the developing sleeve, whereby toner in the developer is oscillated between the plate member and the developing sleeve, the bias member further forming a second oscillating electric field between the photoreceptor and the developing sleeve whereby toner flies from the developer layer to the photoreceptor, the bias member being arranged to adjust an electric potential of each of the photoreceptor, the developing sleeve and the electrode member so that the first oscillating electric field is stronger than the second oscillating electric field; and wherein the electrode member includes a control electrode which is a plate-like member and is included at an angle $\theta$ relative to a line that is perpendicular to a line being connected between a center of the photoreceptor and a center of the developing sleeve, and wherein the angle $\theta$ satisfies the following relation:

$$5^\circ \leqq \theta \leqq 45^\circ.$$

8. The apparatus of claim 7, wherein the first and second oscillating electric fields each comprise an AC component and a DC component, and wherein another electric field which is established between the electrode member and the photoreceptor by the bias member only has a DC component.

9. The apparatus of claim 8, wherein a phase of the AC component of the first oscillating electric field corresponds to a phase of the AC component of the second oscillating electric field.

10. The apparatus of claim 7, wherein the developer is a two component type developer which includes carrier particles and toner particles.

11. The apparatus of claim 7, wherein the developer is a one component type developer.

12. The apparatus of claim 7, wherein the control electrodes of the electrode member is disposed in a downstream direction of the contact portion between the developing sleeve and the plate member when viewed in said conveying direction.

13. The apparatus of claim 12, wherein the plate member is pressed onto the developing sleeve at the contact portion.

14. A non-contact type of developing apparatus for developing an electrostatic latent image formed on a photoreceptor with developer containing toner, comprising:

a developing sleeve disposed to face the photoreceptor so that a developing region is formed between the developing sleeve and the photoreceptor, wherein a toner contained in a developer is attracted on the developing sleeve so that a developer layer is formed on the developing sleeve and the developer is conveyed in a conveying direction to the developing region;

an insulating plate member placed between the photoreceptor and the developing sleeve and positioned upstream of the developing region when viewer in the conveying direction, a part of the plate member being arranged to be brought in contact with the developer layer on the developing sleeve so that the developer layer does not contact the photoreceptor in the developing region;

a conductive electrode member fixed to the plate member so that the electrode member is positioned between the photoreceptor and the developing sleeve; and a bias member for forming a first oscillating electric field between the electrode member and the developing sleeve, whereby the toner in the developer is oscillated between the plate member and the developing sleeve, said bias member forming a second oscillating electric field between the photoreceptor and the developing sleeve, the bias member being arranged to adjust an electric potential of each of the photoreceptor, the developing sleeve and the electrode member so that the first oscillating electric field is stronger than the second oscillating field; and wherein the electrode member includes a control electrode which is disposed downstream of the contact portion between the developing sleeve and the plate member when viewed in the conveying direction.

15. The apparatus of claim 14, wherein the first and second oscillating electric fields each comprise an AC component and a DC component, and wherein another electric field that is established between the electrode member and the photoreceptor only has a DC component.

16. The apparatus of claim 15, wherein a phase of the AC component of the first oscillating electric field is the same as a phase of the AC component of the second oscillating electric field.

17. The apparatus of claim 14, wherein the developer is a two component type developer which includes carrier particles and toner particles.

18. The apparatus of claim 14, wherein the developer is a one component type developer.

19. The apparatus of claim 14, wherein the control electrode of the electrode member is a plate-like member and is inclined at an angle $\theta$ to a line perpendicular to a line being connected between a center of the photoreceptor and a center of the developing sleeve, and wherein the angle $\theta$ satisfies the following relation:

$$5^\circ \leqq \theta 45^\circ.$$

20. The apparatus of claim 14, wherein the plate member is pressed onto the sleeve at the contact position.

* * * * *